US006083668A

United States Patent [19]

Matsumoto et al.

[11] Patent Number: 6,083,668

[45] Date of Patent: Jul. 4, 2000

[54] PROCESSING ELEMENT AND IMAGE-FORMING METHOD USING SAME

[75] Inventors: Kazuhiko Matsumoto; Masaru Yoshikawa, both of Kanagawa, Japan

[73] Assignee: Fuji Photo Film Co., Ltd., Kanagawa, Japan

[21] Appl. No.: 09/281,964

[22] Filed: Mar. 31, 1999

[30] Foreign Application Priority Data

Apr. 1, 1998 [JP] Japan ..... 10-105465

[51] Int. Cl.[7] ..... G03C 1/43; G03C 1/498; G03C 5/38; G03C 7/32; G03C 7/407

[52] U.S. Cl. ..... 430/351; 430/206; 430/251; 430/353; 430/404; 430/455

[58] Field of Search ..... 430/206, 351, 430/353, 404, 455, 264, 251

[56] References Cited

U.S. PATENT DOCUMENTS

| | | | |
|---|---|---|---|
| 4,582,775 | 4/1986 | Toriuchi et al. | 430/219 |
| 4,624,913 | 11/1986 | Minasaka et al. | 430/611 |
| 5,298,373 | 3/1994 | Sasaoka et al. | 430/455 |
| 5,401,621 | 3/1995 | Kojima et al. | 430/455 |
| 5,472,822 | 12/1995 | Hayashi | 430/251 |
| 5,773,560 | 6/1998 | Asami | 430/351 |
| 5,888,704 | 3/1999 | Kikuchi | 430/351 |

*Primary Examiner*—Richard L. Schilling
*Attorney, Agent, or Firm*—Sughrue, Mion, Zinn, Macpeak & Seas, PLLC

[57] ABSTRACT

Disclosed is a processing element which includes a silver halide solvent represented by a general formula (1) and which has a function of efficiently fixing undeveloped silver halide remaining in a photosensitive element after developing without any harmful influence, and an image-forming method using the processing element, the general formula (1) being (general formula (1))

wherein $R_1$ and $R_2$ each represent an aliphatic hydrocarbon group.

20 Claims, No Drawings

PROCESSING ELEMENT AND IMAGE-FORMING METHOD USING SAME

BACKGROUND OF THE INVENTION

1. Field of the Invention

The present invention relates to a processing element used for treating a photosensitive element containing a silver halide, and particularly, to a processing element having a function to efficiently fix undeveloped silver halide remaining in a photosensitive element after development without any harmful influence and an image-forming method using the processing element.

2. Description of the Related Art

A photographic method using a silver halide is excellent in photographic characteristics such as sensitivity and gradation adjustment as compared with other photographic methods, for example electrophotography and diazo photography, and for this reason has heretofore been used in a wider scope of applications than any other photographic method. Since silver halide photography provides the highest image quality in terms of color hard copies, energetic research has been conducted in recent years.

Recently, a system has been developed in which a thermal developing process using a heat treatment substitutes for a conventional wet treatment in an image-forming treatment method for a photosensitive material containing a silver halide. An image can thereby be obtained in a simple, easy and quick manner.

In Japanese Patent Application Laid-Open (JP-A) Nos. 8-179458, 8-339065 and the like, a method is disclosed in which: a base and/or a basic precursor is mixed into a photosensitive element and/or a processing element; the photosensitive element is exposed to light; thereafter the photosensitive element and the processing element are stuck to each other; and thus stuck both elements are subjected to thermal development in the presence of a small amount of water between the elements, whereby a silver image is created on the photosensitive element.

On the other hand, in Japanese Patent Application Laid-Open (JP-A) Nos. 9-146247 and 9-204031, a method is disclosed in which: a photosensitive element having a photosensitive layer containing a silver halide, a binder, a color developing agent and a coupler on a substrate and a processing element having a treatment layer containing a basic precursor on a substrate are used; the photosensitive element is imagewise exposed to light; thereafter the photosensitive element and the processing element are stuck to each other; and thus stuck both elements are subjected to thermal development in the presence of a trace of water between the elements, whereby a high quality color image is created on the photosensitive element. In the publications, a method is also proposed in which the thus obtained image is read in a digitized form as image information and another image is created on a different record medium based on the image information.

In the above described image-forming methods, a silver image or a color image obtained on a photosensitive element is unstable since the images exist together with undeveloped silver halide. For this reason, if the silver image or the color image is observed or read on image information thereof in a digitized form after a period elapses following the developing of the images only, a deteriorated image or poor image information can be acquired.

Further, since the average density increases, if undeveloped silver halide remains on the photosensitive element, not only does it take a very long period of time to read image information on the photosensitive element in a digitized form but it is difficult to read the image information at a good S/N ratio.

In order to avoid the above described problems, a method is disclosed in Japanese Patent Application Laid-Open (JP-A) No. 9-258402, in which a processing element having a treatment layer containing a compound with a function of dissolving developed silver and/or a silver halide is stuck to a photosensitive element after developing and then both elements are heated in the presence of a small amount of water to dissolve the undeveloped silver halide in the photosensitive element. When the silver halide is dissolved, the density of the photosensitive element decreases, so that read can be performed at a good S/N ratio. In addition, an image is stabilized, since no developing reaction occurs during storage.

A silver halide solvent employed in an example described in Japanese Patent Application Laid-Open (JP-A) No. 9-258402 is found to be problematic since a silver complex of the silver halide solvent that remains in a photosensitive element after treatment is deposited on the surface of the photosensitive element during storage following the treatment. In the publication, it is described that various kinds of silver halide solvents such as compounds that fix and stabilize silver halides, which are described in Japanese Patent Application No. 6-206331(Japanese Patent Application Laid-Open (JP-A) No. 8-69097) can be employed. The publication, however, discloses no guidelines line for selection of a compound having a specific property of swiftly diffusing from a processing element into a photosensitive element and efficiently dissolving a silver halide, wherein, as a particularly important point, a silver complex formed thereafter is not deposited on the surface of the photosensitive element.

SUMMARY OF THE INVENTION

An object of the present invention is to provide a processing element having a function of efficiently fixing undeveloped silver halide remaining in a photosensitive element after developing without any harmful influence, and an image-forming method using the processing element.

The above described object has been achieved by the following means.

(1) A processing element comprising a silver halide solvent represented by a general formula (1):

General formula (1)

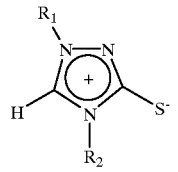

wherein $R_1$ and $R_2$ each represent an aliphatic hydrocarbon group.

(2) A processing element according to the above-described (1), further comprising a neutralizer.

(3) A processing element according to the above-described (2), wherein the neutralizer is an acid or an acid precursor.

(4) A processing element according to the above-described (3), wherein the acid is an acid polymer.

(5) An image-forming method for forming an image on a photosensitive element comprising steps:

imagewise exposing the photosensitive element having a photosensitive layer comprising a support having thereon a silver halide and a binder;

thereafter, conducting developing processing of the photosensitive element in the presence of at least a base;

subsequently, superposing a photosensitive layer of the photosensitive element, which has been subjected to developing processing, and a processing element on each other in the presence of water in an amount in a range of from 1 cc/m$^2$ to 50 cc/m$^2$ between the photosensitive layer and the processing element;

heating the superposed composite at a temperature in a range of from 40° C. to 100° C. for a period of time in a range of from 2 seconds to 60 seconds; and thereafter, separating the photosensitive element from the processing element, wherein the processing element is the processing element according to claim 1.

(6) An image-forming method according to the above-described (5), wherein the photosensitive layer further comprises a coupler.

(7) An image-forming method for forming an image on a photosensitive element comprising steps:

imagewise exposing the photosensitive element having a photosensitive layer comprising a support having thereon a silver halide, a color developing agent, a coupler and a binder;

thereafter, superimposing on each other a photosensitive layer of the photosensitive element, which has been subjected to the exposing treatment, and a processing layer of a developing processing element comprising a support having thereon a base and/or a base precursor, in the presence of water in an amount in a range of from 1 cc/m$^2$ to 50 cc/m$^2$ between the photosensitive layer and the treatment layer;

heating the superimposed composite at a temperature in a range of from 60° C. to 100° C. for a period of time in a range of from 5 seconds to 60 seconds;

thereafter, separating the photosensitive element from the developing processing element;

subsequently, superimposing the photosensitive layer of the photosensitive element, which has been subjected to developing processing, and a processing element on each other in the presence of water in an amount in a range of from 1 cc/m$^2$ to 50 cc/m$^2$between the photosensitive layer and the processing element;

heating the superimposed composite at a temperature in a range of from 40° C. to 100° C. for a period of time in a range of from 2 seconds to 60 seconds; and thereafter, separating the photosensitive element from the processing element, wherein the processing element is the processing element according to any one of the above-described (1) to (4).

(8) An image-forming method according to the above-described (6) or (7), wherein the photosensitive element contains at least one of color developing agents represented by the following general formulae (2) to (6):

General formula (2)

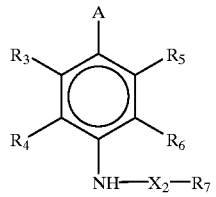

General formula (3)

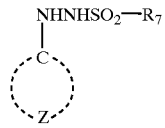

General formula (4)

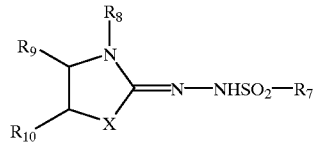

General formula (5)

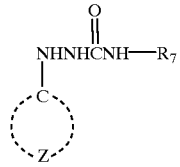

General formula (6)

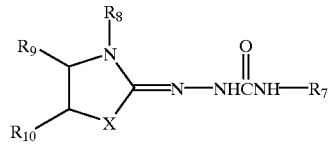

wherein A represents a hydroxyl groups, or an amino group with a substituent; $X_2$ represents a connecting group selected from the group consisting of —CO—, —SO—, —$SO_2$— and —(Q)PO— (wherein Q represents a monovalent group that bonds to a phosphorus atom); each of $R_3$ to $R_6$ represents a hydrogen atom, a halogen atom, an alkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsufamoyl group, an arylsufamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, a ureido group, a urethane group, or an acyloxy group; and $R_7$ represents a substituted or unsubstituted alkyl group, aryl group or heterocyclic group;

wherein $R_3$ and $R_4$, and $R_5$ and $R_6$ may respectively be linked with each other to form a ring through coupling therebetween; and wherein Z represents an atomic group forming an aromatic ring (including an aromatic heterocycle) and when Z is a benzene ring having substitueats, the sum of Hammett's constants σ ($\sigma_p$+$\sigma_m$) of the substituents is 1 or more; $R_8$ represents an alkyl group with or without a substituent; X represents anoxygenatom, a sulfur atom, a selenium atom or a tertiary nitrogen atom with alkyl or aryl substituents; and $R_9$ and $R_{10}$ each represent a hydrogen atom or a substituent and may be linked with each other to form a double bond or a ring.

(9) An image-forming method according to any of the above-described (6) to (8), wherein the photosensitive element includes a compound represented by the following general formula (9):

General formula (9)

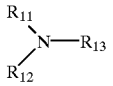

wherein $R_{11}$ and $R_{12}$ each independently represent a hydrogen atom, an aliphatic group or an aryl group; and $R_{13}$ represents an aliphatic group or a group represented by the following general formula (Ab):

General formula (Ab)

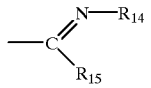

wherein $R_{14}$ represents a hydrogen atom, an aliphatic group or an aryl group; and $R_{15}$ represents an aliphatic group, an aryl group or an amino group; and wherein $R_{11}$ and $R_{12}$, $R_{11}$ and $R_{13}$, $R_{12}$ and $R_{13}$, and $R_{14}$ and $R_{15}$ may respectively be linked with each other to form a 5 to 7-elemented ring; three groups of $R_{11}$, $R_{12}$ and $R_{13}$ may be linked with each other to form a bicyclic compound, with the proviso that the total number of carbon atoms of $R_{11}$, $R_{12}$ and $R_{13}$ is 10 or more, and at least one of $R_{11}$ and $R_{12}$ is an aliphatic group and furthermore, when $R_1$, (or $R_{12}$) is an aliphatic group and $R_{12}$ (or $R_{11}$) is an aryl group, $R_{13}$ represents a group represented by the general formula (Ab).

(10) An image-forming method comprising steps: forming a first image on a photosensitive element by means of a method according to any one of the above-described (5) to (9); and then forming a second image on a different recording material based on information of the first image.

(11) An image-forming method comprising steps: forming a first image on a photosensitive element by means of a method according to any one of the above-described (5) to (9); reading image information from the first image; and then forming a second image on a different recording material based on the image information.

DETAILED DESCRIPTION OF THE INVENTION

The present invention is based on a discovery that not only is a silver halogen solvent of the general formula (1) excellent in terms of ability to dissolve a silver halide, but it is difficult to crystallize a silver complex of the silver halide solvent, and even when the silver complex of the silver halide solvent remains in a photosensitive material, deposition of the silver complex does not occur.

In the present invention, a photosensitive element on which an image is formed by developing is superposed on a processing element including a silver halide solvent, preferably, in the presence of a small amount of water to dissolve a silver halide in the photosensitive element. By applying such a simple and easy treatment the silver halide that remains in the photosensitive element is removed (fixed), an undeveloped portion of the photosensitive element becomes transparent and an increase in density due to a developing reaction after the treatment can be almost completely inhibited. Besides, it has been made clear that by employing the silver halide solvent in the present invention, quick stabilization can be executed and at the same time, even when the silver complex of the silver halide solvent remains in the photosensitive material, deposition of the silver complex does not occur and storage over a long period of time can be realized without any degradation.

In a color photosensitive material including a dye forming coupler, a silver halide is commonly used in great excess of (5 times or more) the amount of silver necessary for color formation, in order to improve sensitivity/image quality. Hence, since the density of the remaining silver halide is so high that reading is negatively effected to a large degree, the present invention is effective in application to a treatment of the photosensitive element in cases in which the photosensitive element includes the dye forming coupler.

The processing element of the present invention is a element having a treatment layer containing at least the silver halide solvent represented by the general formula (1) on a substrate. A form thereof is preferably that of a sheet or a web.

As aliphatic hydrocarbon groups represented by $R_1$ in the formula (1), there are named a straight-chain alkyl group with no substituent (for example, a methyl group, an ethyl group, an n-propyl group, an n-butyl group and the like), an alkenyl group (for example, an allyl group and the like) and the like.

As aliphatic hydrocarbon groups represented by $R_1$ in the formula (1), there are named straight-chain or branched-chain alkyl groups each having no substituents (for example, a methyl group, an ethyl group, an iso-propyl group, an n-propyl group, an n-butyl group, a sec-butyl group, an iso-butyl group, a t-butyl group and the like), cyclic alkyl groups each with no substituent (for example, a cyclopropyl group, a cyclopentyl group, a cyclohexyl group and the like), alkenyl groups (for example, an allyl group, a 2-butenyl group, a 3-pentenyl group and the like), alkynyl groups (for example, a propargyl group, a 3-pentynyl group and the like) and the like.

In the general formula (1), it is preferable that: $R_1$ is a straight-chain alkyl group without a substituent and having 1 to 3 carbon atoms; $R_2$ is either a straight-chain, branched-chain, or cyclic alkyl group without a substituent and having 1 to 5 carbon atoms, or a straight-chain, branched-chain, or cyclic alkenyl group without a substituent and having 3 to 5 carbon atoms; and the molecular weight of the general formula (1) is 250 or less.

In the general formula (1), it is more preferable that: $R_1$ is a straight-chain alkyl group without a substituent and having 1 to 2 carbon atoms; $R_2$ is either a straight-chain, branched-chain, or cyclic alkyl group without a substituent and having 1 to 3 carbon atoms, or an allyl group; and the molecular weight of the general formula (1) is 200 or less.

It is further more preferred that in the general formula (1), $R_1$ is a methyl, $R_2$ is a straight-chain alkyl group without a substituent and having 1 to 3 carbon atom or atoms or a allyl group; and a molecular weight of the general formula (1) is 170 or less.

Below are listed concrete examples represented by the general formula (1), but the present invention is not limited by the following:

Compound (F-1)
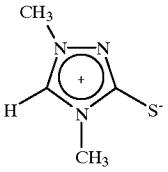
Compound (F-2)
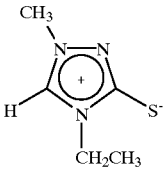
Compound (F-3)
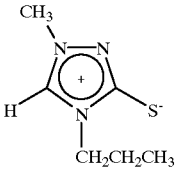
Compound (F-4)
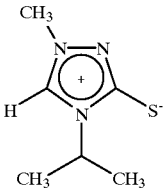
Compound (F-5)
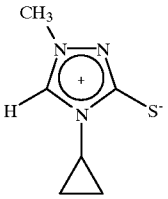
Compound (F-6)
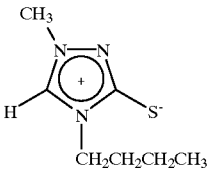
Compound (F-7)
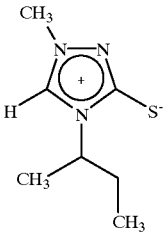
-continued
Compound (F-8)
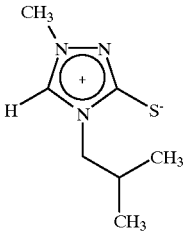
Compound (F-9)
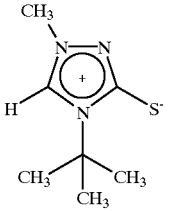
Compound (F-10)
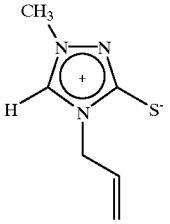
Compound (F-11)
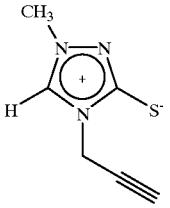
Compound (F-12)
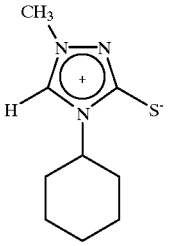
Compound (F-13)
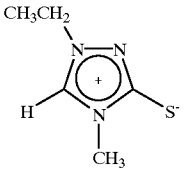
Compound (F-14)
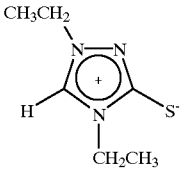

-continued
Compound (F-15)
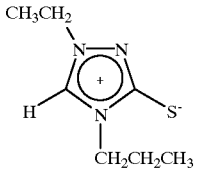
Compound (F-16)
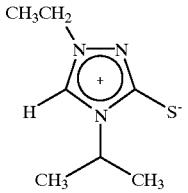
Compound (F-17)
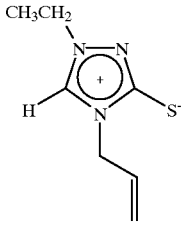
Compound (F-18)
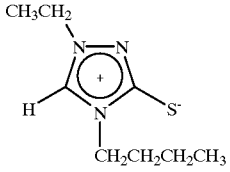
Compound (F-19)
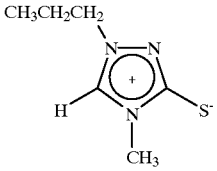
Compound (F-20)
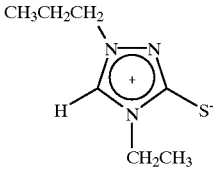
Compound (F-21)
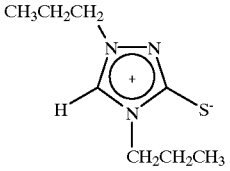
-continued
Compound (F-22)
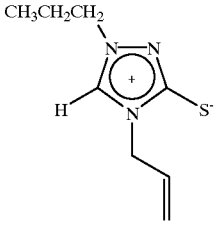
Compound (F-23)
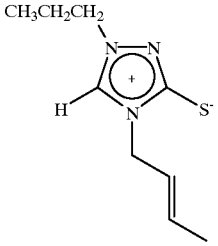
Compound (F-24)
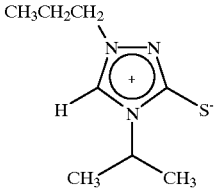
Compound (F-25)
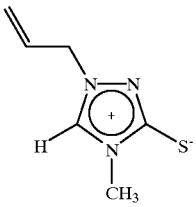
Compound (F-26)
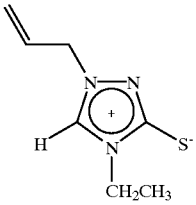
Compound (F-27)
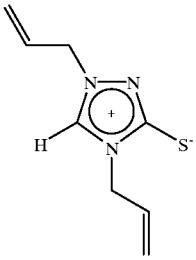

-continued

Compound (F-28)

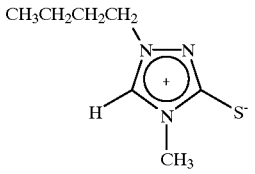

Compound (F-29)

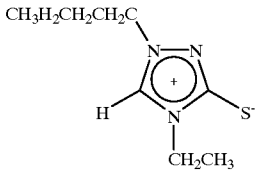

Compound (F-30)

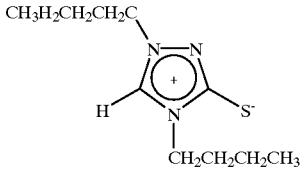

Compounds represented by the general formula (1) can be synthesized by means of methods which have been described in the following: *J. Heterocyclic Chem.*, 2, 105 (1965); *J. Org. Chem.*, 32, 2245 (1967); *J. Chem. Soc.*, 3799 (1969); *J. Am. Chem. Soc.*, 80, 1895 (1958); *Chem. Commun.*, 1222 (1971); *Tetrahedron Lett.*, 2939 (1972); Japanese Patent Application Laid-Open (JP-A) No. 60-87322; *Berichte der Deutschen Chemischen Gesellshaft*, 38, 4049 (1905); *J. Chem. Soc. Chem. Commun.*, 1224 (1971); Japanese Patent Application Laid-Open (JP-A) Nos. 60-122936, 60-117240; *Advances in Heterocyclic Chemistry*, 19, 1 (1976); *Tetrahedron Lett.*, 5881 (1968); *J. Heterocyclic Chem.*, 5, 277 (1968); *J. Chem. Soc. Perkin. Trans.*, 627 (1974); *Tetrahedron Lett.*, 1809 (1967); ibid. 1578 (1971); *J. Chem. Soc.*, 899 (1935); ibid. 2865 (1959); *J. Org. Chem.*, 32, 2245 (1967) ibid. 30, 567 (1965) and the like.

Below, a concrete example of synthesis is given. Synthesis of compound (F2)

Monomethyl hydrazine (94 g, 2 mol) and an equivalent amouny of ethyl formate (153 g, 2 mol) were reacted with each other in 300 ml of methanol to produce N-formyl N-methyl hydrazine. Thereafter, ethyl isothiocyanate (174 g, 2 mol) was slowly added in drops while cooling with ice water and after completion of the addition in drops, the solution was heated to 40° C. and stirred for two hours. The reaction solution was cooled again with ice water, and thereafter, a 28% solution of sodiummethoxide inmethanol (8.2 ml, 40 mmol), as acatalyst, was added to the cooled reaction solution. The result was stirred at 20° C. for 1 hour. The reaction solution was concentrated under reduced pressure and thereafter ethyl acetate was added. The deposited crystals were filtered and then the crystals were subjected to recrystallization with a mixed solvent of methanol/ethyl acetate, whereby the compound (F2) (171 g, 1.2 mol) was obtained.

Compounds represented by the general formula (1) are characterized in that it is difficult for crystallization to occur in or on a surface of a photosensitive material film of a silver complex, which is produced through a reaction with a silver halide, as compared with well-known silver halide solvents (for example, a thiosulfate, a sulfite, thiocyanate, and a thioether compound described in Japanese Patent Application Laid-Open (JP-A) No. 47-11386; compounds with an imide group of a 5 to 6-elemented ring such as uracil and hydantoin, described in Japanese Patent Application Laid-Open (JP-A) No. 8-179458; a compound with a double bond between a carbon atom and a sulfur atom described in Japanese Patent Application Laid-Open (JP-A) No. 53-144319; a mesoionic thiolate compound such as trimethyl triazolium thiolate described in *Analitica Chimica Acta*, Vol. 248, pp. 604 to 614 (1991) and the like).

The compounds represented by the general formula (1) can be employed singly or preferably in a combination of a plurality of compounds represented by the general formula (1).

The total contained amount of the silver halide solvent in a treatment layer is preferably in a range of from 0.01 to 100 mmol/$m^2$, and particularly preferably in a range of from 0.1 to 50 mmol/$m^2$. The mole ratio of the total contained amount of the silver halide solvent to the amount of coated silver is preferably in a range of from 1/20 to 20, particularly preferably in a range of from 1/10 to 10, and further preferably in a range of from 1/4 to 4.

The silver halide solvent may be added to the coating solution using such solvents such as water, methanol, ethanol, acetone, dimethyl formaldehyde, methyl propylene glycol or the like, as an acidic aqueous solution, or in the form of solid fine particles in a dispersed phase.

The treatment layer of the processing element preferably employs a water soluble polymer as a binder. As examples, there are named those described in *Research Disclosure*, Item 17643, p. 27; ibid., Item 18716, p. 651; ibid., and Item 307105, pp. 873 to 874, and Japanese Patent Application Laid-Open (JP-A) No. 64-13546, pp. 71 to 75. Among these, the following are preferable: gelatin and combinations thereof with other water-soluble binders (for example, a polyvinyl alcohol, a modified polyvinyl alcohol, a cellulose derivative, an acrylic amide polymer and the like).

It is preferred that the treatment layer of the processing element of the present invention includes a neutralizer for reducing (neutralizing) the pH of a constituent layer of the photosensitive element, which becomes alkaline during developing. As the neutralizer, an acid or an acid precursor can be used. As the acid, any known acid may be adopted. Specifically, the following acids may be used: inorganic acids such as hydrochloric acid and sulfuric acid; and organic acids such as oxalic acids formic acid, and carboxylic acid (such as acetic acid, propionic acid, stearic acid and behenic acid). Furthermore, the neutralizer may also be an acid precursor that releases an acid on heating, described in Japanese Patent Application Laid-Open (JP-A) Nos. 60-108837, 60-192939, 60-230133 and the like; and electrophilic compounds that cause a substitution reaction with a base on heating, described in Japanese Patent Application Laid-Open (JP-A) No. 60-230134.

An acid polymer that does not migrate out from a processing element is preferably employed among the acids since such an acid polymer is less problematic in terms of handling the photosensitive element after the treatment. As examples of such acid polymers, there can be named: polymers of acrylic acid, methacrylic acid or maleic acid, partial esters thereof, or partial acid anhydrides thereof as described in U.S. Pat. No. 3,362,819; a copolymer of acrylic acid and acrylic ester as described in French Patent No. 2,290,699; an acid polymer of a latex type, as disclosed in U.S. Pat. No. 4,139,383 and Research Disclosure Item 16102 (1977) and the like. These acid polymers are still effective in partially neutralized forms thereof.

The amount of the acid or the acid precursor is preferably in a range of from 0.9 to 2.0 times the amount in moles of a base generated during developing. Actually, it is preferable that the amount is adjusted so that the pH on the film surface of the photosensitive element after a dissolving treatment of the silver halide assumes a value in a range of from 5 to 8 or preferably, from 6 to 7.

A processing element of the present invention may further comprise, in addition to the treatment layer, aprotective layer, an undercoat layer, a back layer, and other auxiliary layers. These layers are preferably hardened with a hardener. The hardener employed here is the same as a hardener for the photosensitive element to be described later.

A substrate for the processing element of the present invention may be either in a shape of a sheet or of a continuous web. It is preferred that the treatment layer is provided on the substrate in the shape of a continuous web, it is also preferred that the substrate is rolled out from a feed roll, and after being used for treatment, is rolled again a round a take-up roll rather than being cut. An example of this situation is described in Japanese Patent Application Laid-Open (JP-A) No. 9-127670.

As a material of the substrate, a plastic film or a paper sheet may be used, as will later be described in connection with the substrate for the photosensitive element. The thickness thereof is preferably in a range of from 4 $\mu$m to 120 $\mu$m, preferably of from 6 $\mu$m to 70 $\mu$m. A film that is vapor-deposited with aluminum, as described in Japanese Patent Application Laid-Open (JP-A) No. 9-222690 can also be preferably used.

In the present invention, it is preferable that a developing processing of the photosensitive element is performed with a developing processing element containing a base or a base precursor, since all the treatment processes can then be conducted in using a simple dry system.

In a preferred example of the present invention, the photosensitive element containing a color developing agent represented by the general formulae (2) to (6) and a coupler, and the processing element containing a base and/or a base precursor are used, and both elements are heated in the presence of a small amount of water for developing, to create an image with a non-diffusible dye on the photosensitive element. Since the color developing agent represented by the general formulae (2) to (6) has a property wherein the agent has an extremely high stability in the absence of a base, the photosensitive element using such a color developing agent demonstrates excellent storage stability before treatment. Using this image-forming method, an image that is excellent in terms of granularity and sharpness can be achieved and when image data based on the image information is output onto a different record medium such as color paper, thermal developing color print material and the like, an image with very good quality can be obtained. Besides, since the photosensitive element and the base are kept separate before developing, high storage stability, which is required by the photographic material, is realized, and quick developing processing is made possible.

When A in the general formulae (3), (5) and (2) is a hydroxyl group among the above-described color developing agents, a dye obtained through use of one of these color developing agents can take on either of two structures of a proton dissociating state and a proton non-dissociating state. In general, a color image is attained with a dye in a dissociating state. At this point, when neutralization is conducted during a dissolution treatment of silver halide dissolution a dye in a non-dissociating state may be produced depending on the pKa value of the dye. It is useful to have a tertiary amine oil with high hydrophobicity present in order to prevent this from occurring, i.e., to hold the dye in the dissociating state even when neutralization is conducted.

After a stabilized image is obtained in this way, as methods to output onto a different medium based on image information, there may be a method of an ordinary projection exposure or a method to read photo-electrically the image information according to density measurements of transmitted light and then output based on these signals. Media to which the output is supplied may be a silver halide photosensitive material (color paper) which is subjected to an ordinary wet treatment, but a thermal development photosensitive material is especially preferable. In addition to the photosensitive material, the following may be used: a sublimation type thermosensitive record material, an ink jet material, an electrophotographic material, a full-color direct thermosensitive record material and the like.

The photosensitive element that has been treated with a processing element of the present invention exhibits almost no deterioration in image quality even after long term storage and and the like, and high silver chloride tabular grains having major crystal faces lying in {100} crystal planes described in U.S. Pat. Nos. 5,264,337; 5,292,632; 5,310,635 and the like can be preferably used as well.

The emulsion of the present invention is preferably provided with ordinary chemical sensitization and spectral sensitization.

For chemical sensitization, the following methods can be used singly or in combination: a chalcogen sensitizing method employing sulfur, selenium or a tellurium compound; a noble metal sensitizing method employing gold, platinum, iridium or the like; and a so-called reduction sensitizing method in which a compound with a moderate reductive ability is used in the course of grain formation and silver nuclei each with reductive ability are introduced.

For spectral sensitization, a so-called spectral sensitizing dye, which is absorbed to silver halide grains and imparts a sensitivity in its own absorption wavelength region, is preferably used, singly or in combination. Examples thereof include: a cyanine dye, merocyanine dye, complex cyanine dye, complex merocyanine dye, holopolar dye, hemicyanine dye, styryl dye, hemioxonol dye and the like. This spectral sensitizing dye can also be preferably used together with a supersensitizer.

In order to prevent fogging and increase stability during storage, varions kinds of stabilizers are preferably added to the silver halide emulsion of the present invention. Examples thereof include: nitrogen containing heterocyclic compounds therefore, image information of good quality can repeatedly be read from the photosensitive element after long term storage.

Below, a detailed explanation of each material, the structure and the image-forming method will be given.

The silver halide that can be employed in the present invention is any of: silver iodobromide, silver bromide, silver chlorobromide, silver iodochloride, silver chloride, and silver chloroiodobromide. The size of a silver halide grain, when converted to a sphere of the same volume is preferably in a range of from 0.1 to 2 $\mu$m in diameter, particularly 0.2 to 1.5 $\mu$m in diameter.

The silver halide grain used in the present invention can be one having a form comprising normal crystals such as a cube, an octahedron or a tetradecahedron, or a flat hexagonal or rectangular form. Among these, a tabular grain with an aspect ratio of 2 or greater: 1, preferably 8 or greater: 1, or more preferably 20 or greater: 1 is used. An emulsion with the projected area of such tabular grains accounts for 50% or greater, preferably 80% or greater, or more preferably 90% or greater, of the projected area of the total grain population is preferably used.

Grains each having a thickness less than 0.07 $\mu$m and a still higher aspect ratio, described in U.S. Pat. Nos. 5,494,789; 5,503,970; 5,503,971; 5,536,632 and the like can be preferably used as well. High silver chloride tabular grains having major crystal faces lying in {111} crystal planes described in U.S. Pat. Nos. 4,400,463; 4,713,323; 5,217,858 such as azaindenes, triazoles, tetrazoles, purines and the like; and mercapto-compounds such as mercaptotetrazoles, mercaptotriazoles, mercaptoimidazole, mercaptothiadiazoles and the like.

As photographic additives for the silver halide emulsion, those described in *Research Disclosures*, Item 17643 (December, 1978), ibid. Item 18716 (November, 1979), ibid. Item 307105 (November, 1989), ibid. Item 38957 (September, 1996) can be preferably used.

The amount of a photosensitive silver halide used, when converted by calculations based on silver, is of from 0.05 to 20 g/m$^2$, preferably of from 0.1 to 10 g/m$^2$.

A binder with hydrophilicity is preferably used for the photosensitive element and as examples, there are named those described in the above-described *Research Disclosures* and in Japanese Patent Application Laid-Open (JP-A) No. 64-13546, pp. 71 to 75. Among these, gelatin and combinations of gelatin with other water-soluble binders, such as a polyvinyl alcohol, a modified polyvinyl alcohol, a cellulose derivative, an acrylamide polymer and the like are preferred. The coated amount of the binder is suitably in a range of from 1 to 20 g/m$^2$, preferably 2 to 15 g/m$^2$, or more preferably 3 to 12 g/m$^2$. Herein, the percentage of gelatin in the mixture of water-soluble binders is in a range of from 50 to 100%, preferably from 70 to 100%.

As the color developing agent, compounds represented by the general formulae (2) to (6) are preferably employed.

Compounds represented by the general formula (2) are those generally called p-phenylenediamines or p-aminophenols.

In the formula (2): A represents a hydroxyl group or a substituent amino group; $X_2$ represents a coupling group selected from the group consisting of —CO—, —SO—, —$SO_2$— and —(Q)PO—(wherein Q represents a monovalent group); each of $R_3$ to $R_8$ respectively represents a hydrogen atom, a halogen atom (for example, chlorine or bromine), an alkyl group (for example, a methyl group, an ethyl group, an isopropyl group, an n-butyl or t-butyl group), an aryl group (for example, a phenyl group, a tolyl group or a xylyl group), an alkylcarbonamide group (for example, an acetyl amino group, a propionylamino group or a butyloylamino group), an arylcarbonamide group (for example, a benzoylamino group), an alkylsulfonamide group (for example, a methanesulfonylamino group or an ethanesulfonylamine group) an arylsulfonamide group (for example, a benzenesulfonylamino group or a toluenesulfonylamino group), an alkoxy group (for example, a methoxy group, an ethoxy group or a butoxy group), an aryloxy group (for example, a phenoxy group), an alkylthio group (for example, a methylthio group, an ethylthio group or abutylthio group), an arylthio group (for example, aphenylthio group or a tolylthio group), an alkylcarbamoyl group (for example, a methylcarbamoyl group, a dimethylcarbamoyl, an ethylcarbamoyl group, a diethylcarbamoyl group, a dibutylcarbamoyl group, a piperidylcarbamoyl group or a morpholylcarbamoyl group), anarylcarbamoyl group (for example, a phenylcarbamoyl, a methylphenylcarbamoyl, an ethylphenylcarbamoyl or a benzylphenylcarbamoyl), a carbamoyl group, an alkylsufamoyl group (for example, a methylsufamoyl group, a dimethysufamoyl group, an ethylsufamoyl group, a diethysufamoyl group, a dibutylsufamoyl group, a piperidylsufamoyl group or a morpholylsufamoyl group), an arylsufamoyl group (for example, a phenylsufamoyl group, a methylphenylsufamoyl group, an etylphenylsufamoyl group or a benzylsufamoyl group), a sulfamoyl group, a cyano group, an alkylsulfonyl group (for example, a methanesulfonyl group or an ethanesulfonyl group), an arylsulfonyl group (for example, a phenylsulfonyl group, a 4-chlorophenylsulfonyl group or a p-toluenesulfonyl group), an alkoxycarbonyl group (for example, a methoxycarbonyl group, an ethoxycarbonyl group or a butoxycarbonyl group), an aryloxycarbonyl group (for example, a phenoxycarbonyl group), an alkylcarbonyl group (for example, anacetyl group, apropionyl group or abutyloyl group) an arylcarbonyl group (for example, benzoyl group or an alkylbenzoyl), an ureido group, an urethane group, or an acyloxy group (for example, an acetyloxy group, a propionyloxy or a butyloyloxy group). $R_4$ and/or $R_6$ among $R_3$ to $R_6$ is preferably a hydrogen atom. In a case where A is a hydroxyl group, the sum of Hammett's constants ($\sigma_p$) of $R_3$ to $R_6$ is preferably 0 or more. In a case where A is a substitutde amino group, the sum of $\sigma_p$ of $R_3$ to $R_6$ is preferably 0 or less. $R_3$ and $R_4$ may form a ring through coupling therebetween. $R_5$ and $R_6$ may form a ring through coupling therebetween.

In the general formula (2), $R_7$ represents an alkyl group (for example, a methyl group, an ethyl group, a butyl group, anoctyl group, a lauryl group, a cetyl group or a stearyl group), an aryl group (for example, a phenyl group, a tolyl group, a xylyl group, a 4-methoxyphenyl group, a dodecylphenyl group, a chlorophenyl group, a trichlorophenyl group, a nitrochlorophenyl group, a tri-isopropylphenyl group, a 4-dodecyloxyphenyl group or a 3, 5-di-(methoxycarbonyl) group) or a heterocyclic group (for example, a pyridyl group).

In the general formula (2), a combination in which A is a hydroxyl group and $X_2$is —$SO_2$— is preferable.

In the general formula (2), as another preferable color developing agent, compounds represented by the following general formulae (7) and (8) may be employed:

General formula (7)

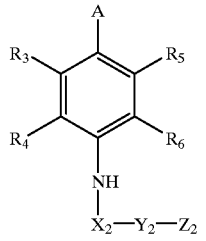

-continued

General formula (8)

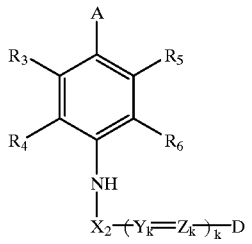

In the formulae (7) and (8), $X_2$ represents a coupling group selected from the group consisting of —CO—, —SO—, —$SO_2$— and —(Q)PO—, wherein Q is a substituent on a phosphorous atom. Specifically, in addition to the above-described substituents represented by $R_3$ to $R_6$, a group represented by the following formula may be used:

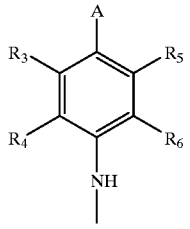

wherein in a case of the general formula (7), Q may also represent —$Y_2$ —$Z_2$. In a case of the general formula (8), Q may also represent —$(Y_k=Z_k)_k$–D, and wherein $Z_2$ represents a nucleophilic group. A nucleophilic group is a group having a function wherein, after an oxidized compound, which is produced by oxidation of a compound of the general formula (7) with a silver halide, couples with a coupler, the nucleophilic group can thereafter attack a carbon atom, a sulfur atom or a phosphorus atom of X in a nucleophilic reaction, so that a dye can be produced. Atoms (for example, a nitrogen atom, a phosphorus atom, an oxygen atom, a sulfur atom and a selenium atom and the like) and anion species (for example, a nitrogen anion, an oxygen anion, a carbon anion and a sulfur anion), each of which has an unshared pair of electrons, can manifest nucleophilicity in nucleophilic groups, as is common in the field of organic chemistry. As examples of the nucleophilic groups, there are named groups each with partial structures described below and groups each with a dissociated species from one of the partial structures.

Examples of partial structures with nucleophilicity included in Z, wherein atoms which are respectively underlined by "═" have nucleophilicity.

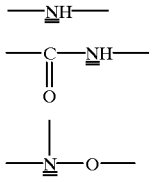

-continued

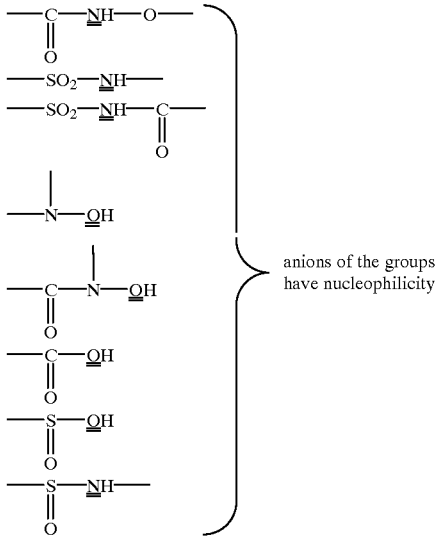

In the general formula (7), $Y_2$ represents a divalent coupling group. The divalent coupling group indicates a group that couples $Z_2$ with $X_2$ at an intra-molecular site of $X_2$ so that an unshared pair of electrons on $Z_2$ and the like can conveniently attack the intra-molecular site of $X_2$ in a nucleophilic reaction via $Y_2$. Actually, it is preferable that, in a transient state when a nucleophilic group attacks $X_2$, atoms of the nucleophilic group are coupled so as to constitute a five-elemented or six-elemented ring. As preferred coupling groups $Y_2$, there can be named, for example: a 1, 2- or 1, 3-alkylene group; a 1, 2-cycloalkylene group; a Z-vinylene group; a 1, 2-arylene group; a 1, 8-naphthylene group and the like.

In the general formula (8), $Y_k$ and $Z_k$ represent groups expressed by nitrogen atom (–N═) or —C ($R_{20}$)═, wherein $R_{20}$ represents a hydrogen atom, a substituent (a halogen atom, an alkyl group, an aryl group, a carbonamide group, a sulfonamide group, an alkoxy group, a aryloxy group, an alkylthio group, an arylthio group, a carbamoyl group, a sulfamoyl group, a cyano group, a sulfonyl group, an alkoxycarbonyl group, an aryloxycarbonyl group, an acyl group, an ureido group, an urethane group, acyloxy group or the like. Here, as additional concrete examples of $R_{20}$, there can be named again the substituents listed as concrete examples in the case of $R_3$ to $R_6$.

k represents an integer equal to 0 or larger, but k is preferably an integer in a range from 1 to 10.

In the general formula (8), D represents a group that can be a proton dissociative group or a cation. D works such that after an oxidized compound produced by an oxidation reaction of a compound represented by the general formula (8) with a silver halide is coupled with a coupler, cutting of a N-$X_2$ bond and release of a substituent coupled with the coupler at a coupling site with electrons transferred from D as the trigger and a dye is thereby produced. Specifically, after a coupling reaction, electrons are transferred to a coupling site from an unshared pair of electrons of an atom on D which becomes an anion or a cation after proton dissociation, a double bond is formed between $X_2$ and $Y_k$ (when k=0, between $X_2$ and D) and the N-$X_2$ bond is thereby cut. Further, another double bond is formed between the coupling site of the coupler and a N atom, and at the same time, a substituent on the coupler side is dissociated as an anion. Through this series in an electron transfer mechanism, formation of a dye and release of a substituent occur. As atoms that can become an anion after proton dissociation, there can be named an oxygen atom, a sulfur atom, a selenium atom, a nitrogen atom or a carbon atom having an electron-attracting group or an aromatic group rich in electrons (for example, an aryl group or an aromatic heterocyclic group) as a substituent thereon and the like. As atoms that can become a cation, there can be named a nitrogen atom, a sulfur atom and the like. A proton dissociative group is a group having an atom that can become an anion after proton dissociations and a group that can become a cation is a group having an atom that can become a cation.

In the general formula (8), D is a substituent including an atom that triggers electron transfer such as that described above. The atom can have various kinds of groups as a substitute. As a substituent of the atom, there can be listed the following examples: an alkyl group (for example, a methyl group, an ethyl group, an isopropyl group, an n-butyl or a t-butyl group), an aryl group (for example, a phenyl group, a tolyl group or a xylyl group), a carbonamide group (for example, an acetylamino group, a propionylamino group, a butyloylamino group or a benzoylamino group), a sulfonamide group (for example, a methanesulfonylamino group, an ethanesulfonylamine group, a benzenesulfonylamino group or a toluenesulfonylamino group) an alkoxy group (for example, a methoxy group or an ethoxy group) an aryloxy group (for example, a phenoxy group), an alkylthio group (for example, a methylthio group, an ethylthio group or abutylthio group), an arylthio group (for example, aphenylthio group or a tolylthio group), a carbamoyl group (for example, a methylcarbamoyl group, a dimethylcarbamoyl, an ethylcarbamoyl group, a diethylcarbamoyl group, a dibutylcarbamoyl group, a piperidylcarbamoyl group, a morpholylcarbamoyl group, a phenylcarbamoyl, a methylphenylcarbamoyl, an ethylphenylcarbamoyl, or a benzyl phenylcarbamoyl), a sufamoyl group (for example, a methylsufamoyl group, a dimethysufamoyl group, an ethylsufamoyl group, a diethysufamoyl group, a dibutylsufamoyl group, a piperidylsufamoyl group, a morpholylsufamoyl group, a phenylsufamoyl group, a methylphenylsufamoyl group, an etylphenylsufamoyl group or a benzylsufamoyl group), a cyano group, a sulfonyl group (for example, a methanesulfonyl group, an ethanesulfonyl group, a phenylsulfonyl group, a 4-chlorophenylsulfonyl group and a p-toluenesulfonyl group), an alkoxycarbonyl group (for example, a methoxycarbonyl group, an ethoxycarbonyl group or a butoxycarbonyl group), an aryloxycarbonyl group (for example, a phenoxycarbonyl group) an acyl group (for example, an acetyl group, a propionyl group, a butyloyl group, a benzoyl group or an alkylbenzoyl group) an acyloxy group (for example, an acetyloxy group, a propionyloxy group or a butyloyloxy group), an ureido group, an urethane group or the like.

As D, the following groups are especially preferable: an aralkyl group (especially a benzyl group), an anilino group, a heterocyclic group, or a methylene group or a methyne group, both having a substituent of an electron-attracting group, wherein these groups may each have a substituent such as a hydroxyl group, an amino group, or a substituent described above as $R_3$ to $R_6$.

Besides, $R_3$ and $R_4$, $R_5$ and $R_6$, and any two or more atoms or substituents selected from the group consisting of $Y_k$, $Z_k$ and D may respectively form rings.

Compounds represented by the general formula (3) are compounds generally called sulfonyl hydrazines. Compounds represented by the general formula (5) are compounds generally called carbamoyl hydrazines.

In the general formulae, Z represents an atomic group forming a aromatic ring. An aromatic ring formed with Z imparts silver development activity to the compounds. Hence, Z is required to be have a sufficient ability to attract electrons and a nitrogen-containing aromatic ring or aromatic ring which is constituted of a benzene ring in which an electron-attracting group can be introduced are preferably employed. As the aromatic ring, a pyridine ring, a pyradine ring, a pyrimidine ring, a quinoline ring and the like are preferable.

In a case of a benzene ring, there can be named as substituents an alkylsulfone group (for example, a methanesulfonyl group or an ethanesulfonylro group) a halogen atom (for example, a chlorine atom or a bromine atom), an alkylcarbamoyl group (for example, a methylcarbamoyl group, a dimethylcarbamoyl group, an ethylcarbamoyl group, a diethylcarbamoyl group, a dibutylcarbamoyl group, a piperidylcarbamoyl group or a morpholylcarbamoyl group), an arylcarbamoyl group (for example, a phenylcarbamoyl group, a methylphenylcarbamoyl group, an ethylphenylcarbamoyl group, or a benzylphenylcarbamoyl group), a carbamoyl group, an alkylsulfamoyl group (for example, a methylsufamoyl group, a dimethysufamoyl group, an ethylsufamoyl group, a diethysufamoyl group, a dibutylsufamoyl group, a piperidylsufamoyl group or a morpholylsufamoyl group), an arylsufamoyl group (for example, a phenylsufamoyl group, a methylphenylsufamoyl group, an etylphenylsufamoyl group or a benzylsufamoyl group), a sulfamoyl group, a cyano group, an alkylsulfonyl group (for example, a methanesulfonyl group or an ethanesulfonyl group), an arylsulfonyl group (for example, a phenylsulfonyl group, a 4-chlorophenylsulfonyl group or a p-toluenesulfonyl group), analkoxycarbonyl group (for example, a methoxycarbonyl group, an ethoxycarbonyl group or butoxycarbonyl group), an aryloxycarbonyl group (for example, a phenoxycarbonyl group), an alkylcarbonyl group (for example, an acetyl group, a propionyl group or a butyloyl group), an arylcarbonyl group (for example, a benzoyl group or an alkylbenzoyl) or the like, wherein the sum of Hammett's constants ($\sigma$) of the above described substituents is 1 or more.

Compounds represented by the general formula (4) are compounds generally called sulfonyl hydrazines. Compounds represented by the general formula (6) are compounds generally called carbamoyl hydrazines.

In the general formulae, $R_8$ represents an alkyl group (for example, a methyl group or an ethyl group) with a substituent or non-substituent. X represents an oxygen atom, a sulfur atom, a selenium atom, or a tertiary nitrogen atom having an alkyl group or an aryl group as a substituent, with the tertiary nitrogen atom having an alkyl group as a substituent being preferable. Both $R_9$ and $R_{10}$ represent a hydrogen atom or a substituent. $R_9$ and $R_{10}$ may form a double bond or a ring by coupling therebetween.

In the present invention, it is preferable that compounds represented by the general formulae (2) to (8) are oil-soluble compounds. In other words, it is preferable that each of the compounds represented by the general formulae (2) to (8) includes at least one group having a ballast property. Here, a ballasting group is an oil-solubility providing group and includes an oil-soluble partial structure with 8 to 80 carbon atoms, preferably 8 to 40 carbon atoms. It is preferable that a position of the ballasting group in the general formulae is in any of $R_3$ to $R_6$, $Y_k$, $Z_k$ and D. Especially, in a case of the general formula (7), it is preferable that the ballast group is included as a substituent in D.

Below, concrete examples of compounds represented by the general formulae (2) to (8) will be shown, but compounds of the present invention represented by the general formulae (2) to (8) are not limited to the following compounds.

D-1
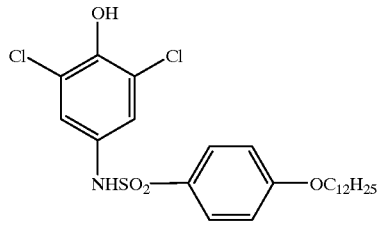
D-2
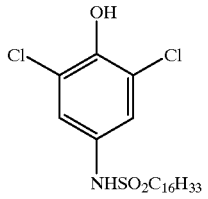
D-3
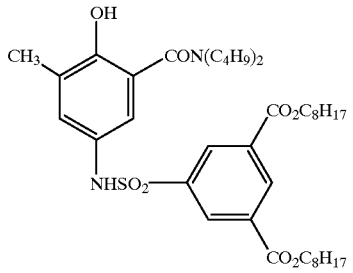
D-4
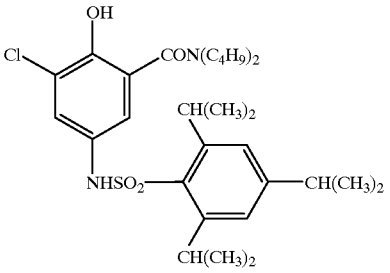
D-5
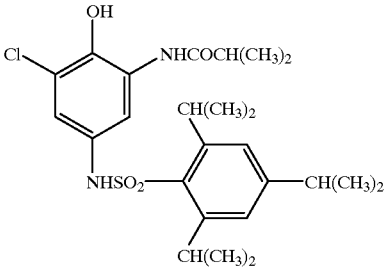
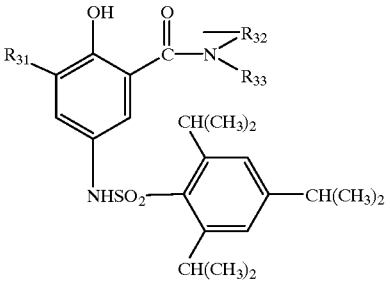

-continued
| | $R_{31}$ | $R_{32}$ | $R_{33}$ |
|---|---|---|---|
| D-6 | $CH_3$— | —$C_2H_5$ | —$C_2H_5$ |
| D-7 | $(CH_3)_3C$— | —$C_2H_5$ | —$C_2H_5$ |
| D-8 | $(CH_3)_2CH$— | —$C_3H_7$ | —$C_3H_7$ |
| D-9 | $CH_3$— | —$C_4H_9$ | —$C_4H_9$ |
| D-10 | $CH_3$— | —$C_6H_{13}$ | —$C_6H_{13}$ |
| D-11 | $CH_3$— | —$C_8H_{17}$ | —$C_8H_{17}$ |
| D-12 | $CH_3$— | —$C_{18}H_{37}$ | —$C_{18}H_{37}$ |
| D-13 | $CH_3$— | —$C_{18}H_{37}$ | —$CH_3$ |
| D-14 | $CH_3$— | —$CH_2CH_2OCH_3$ | —$CH_2CH_2OCH_3$ |
| D-15 | $CH_3$— | —$C_6H_{13}$ | H |
| D-16 | $(CH_3)_3C$— | —$C_4H_9$ | H |
| D-17 | $(CH_3)_2CH$— | —$C_4H_9$ | H |
| D-18 | $CH_3$— | —$C_8H_7$ | H |
| D-19 | $CH_3CONH$— | —$C_2H_5$ | —$C_2H_5$ |
| D-20 | $CH_3CON(CH_3)$— | —$C_2H_5$ | —$C_2H_5$ |
D-21
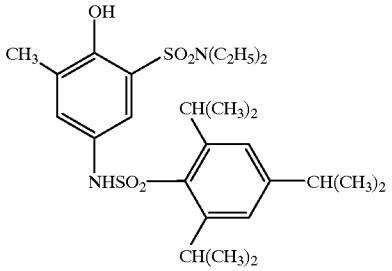
D-22
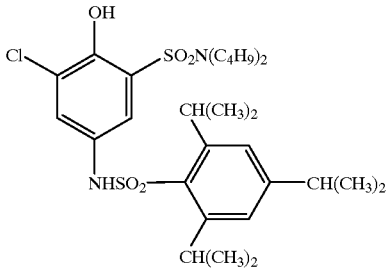
D-23
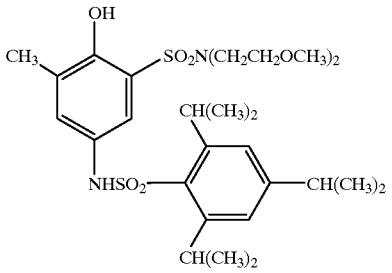
D-24
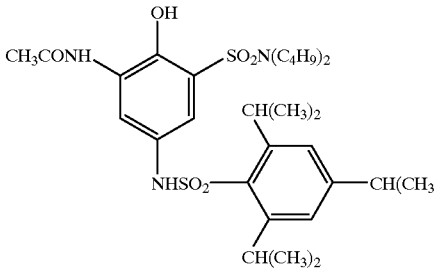

-continued
D-25
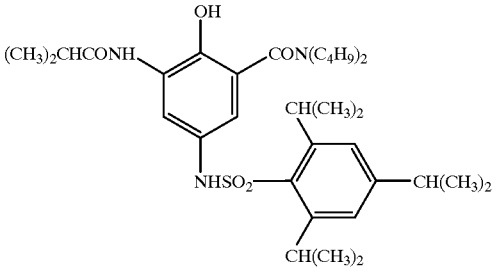
D-26
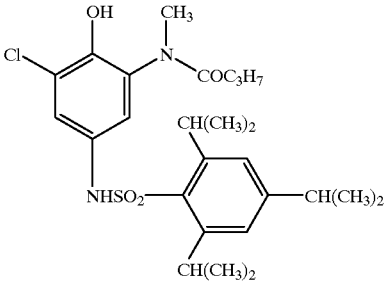
D-27
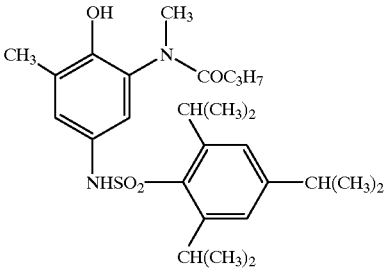
D-28
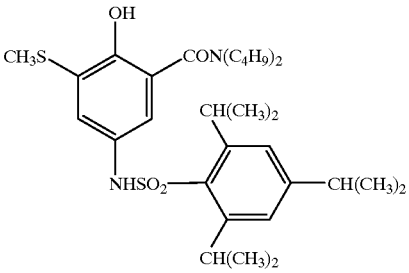
D-29
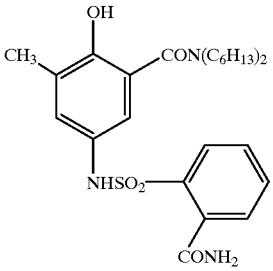

-continued
D-30
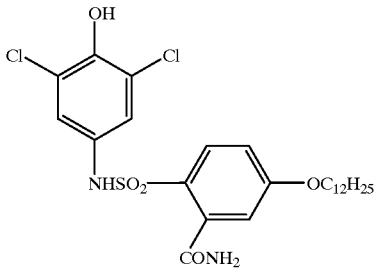
D-31
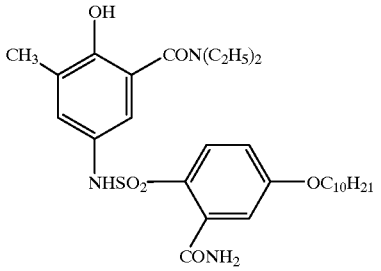
D-32
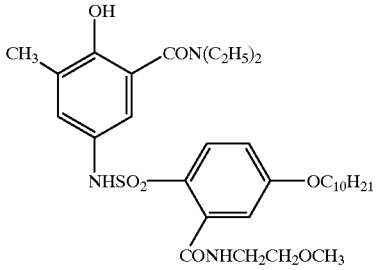
D-33
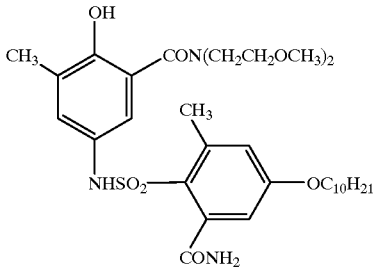
D-34
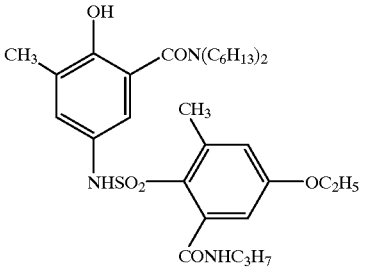

-continued
D-35
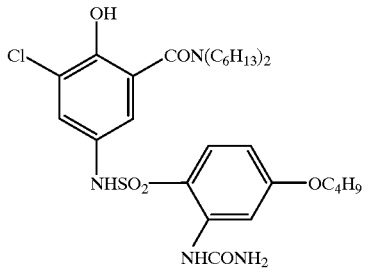
D-36
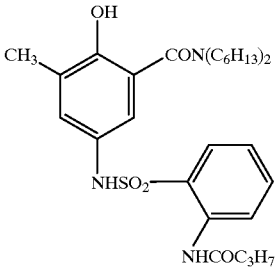
D-37
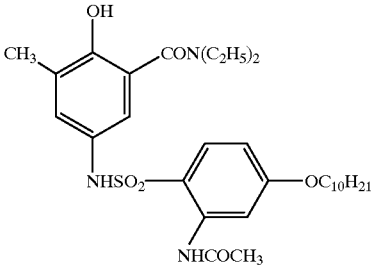
D-38
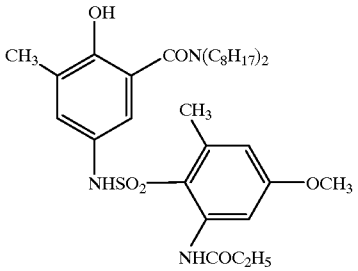
D-39
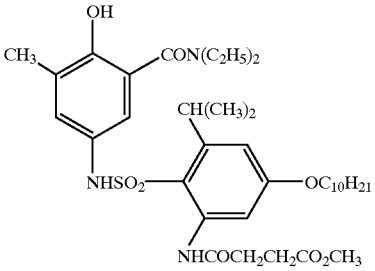

-continued
D-40
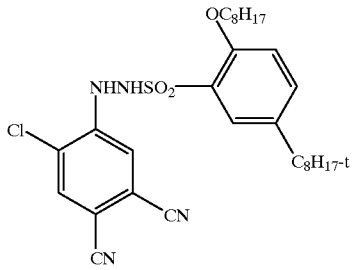
D-41
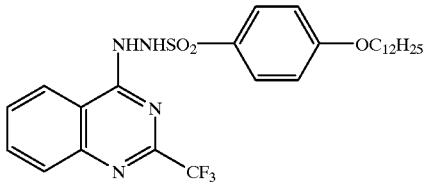
D-42
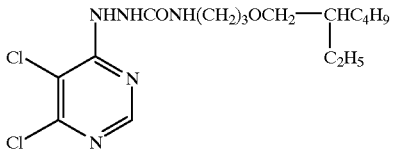
D-43
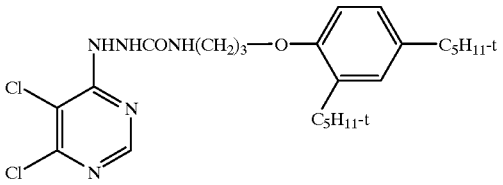
D-44
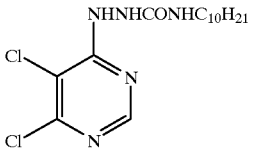
D-45
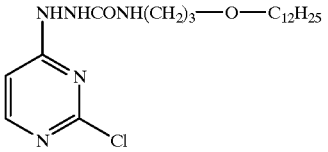
D-46
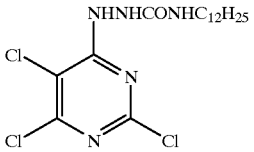
D-47
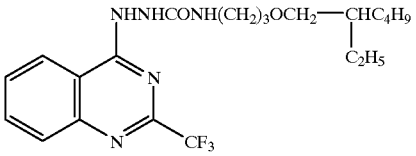

-continued
D-48
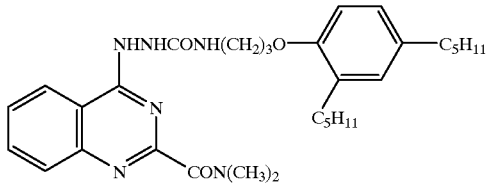
D-49
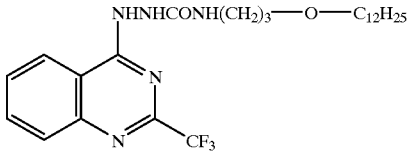
D-50
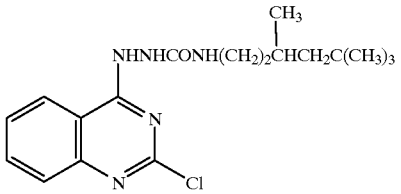
D-51
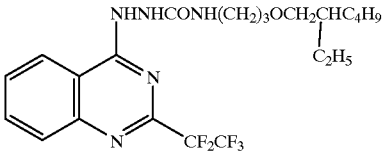
D-51B
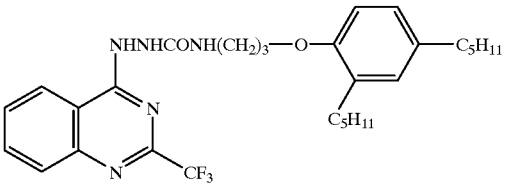
D-52
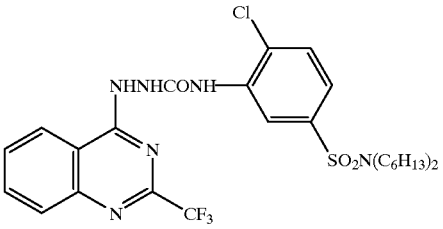
D-53
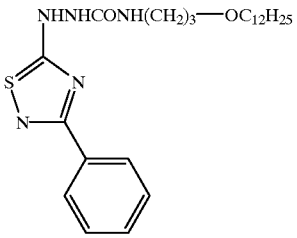

-continued
D-54
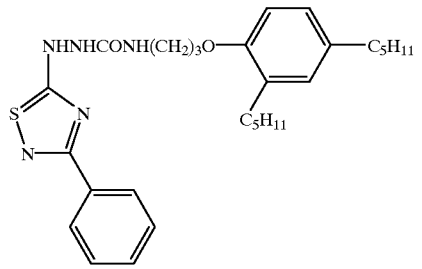
D-55
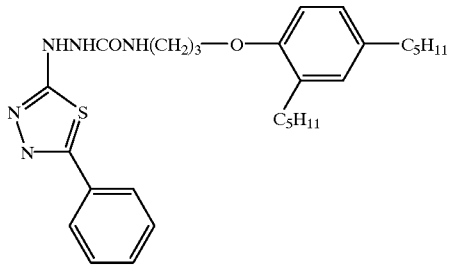
D-56
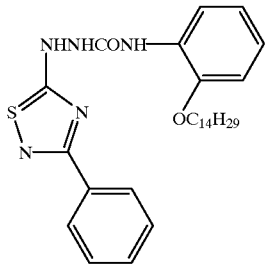
D-57
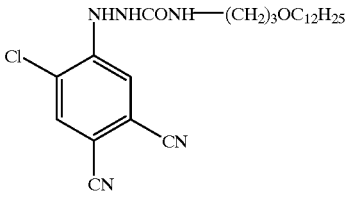
D-58
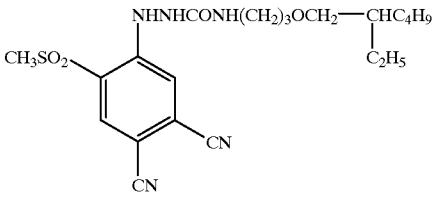
D-59
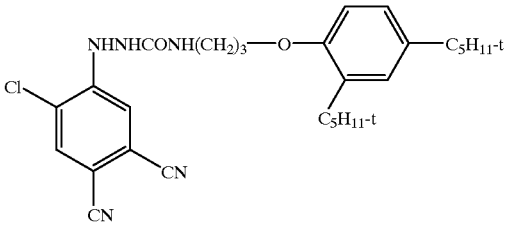

-continued
D-60
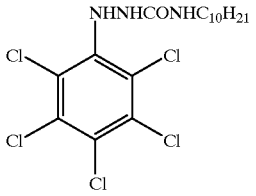
D-61
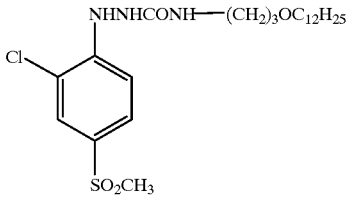
D-62
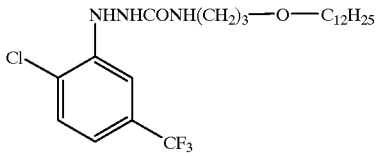
D-63
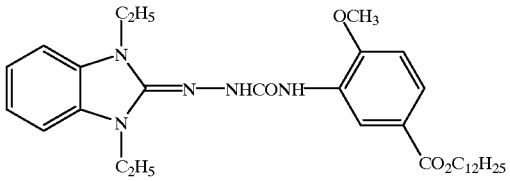
D-64
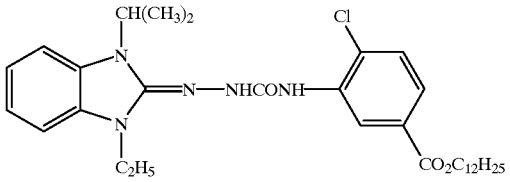
D-65
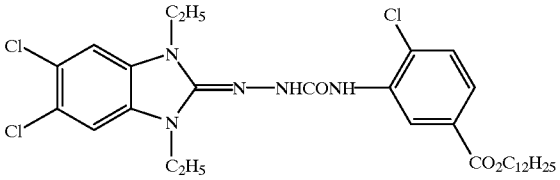
D-66
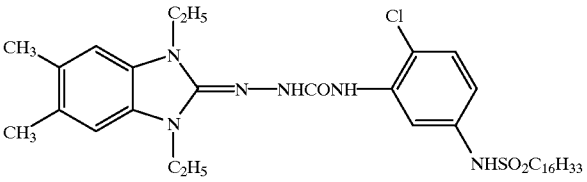

-continued
D-67
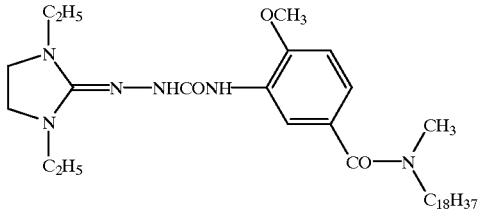
D-68
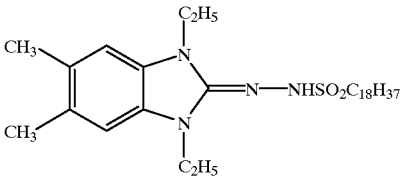
D-69
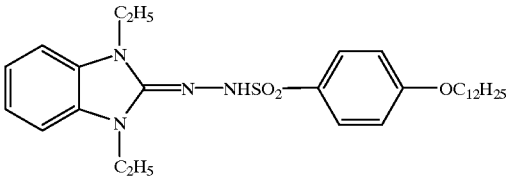
D-70
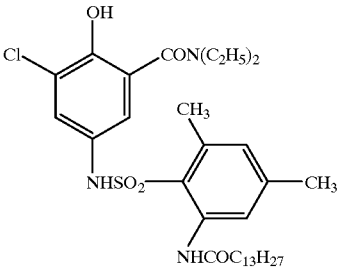
D-71
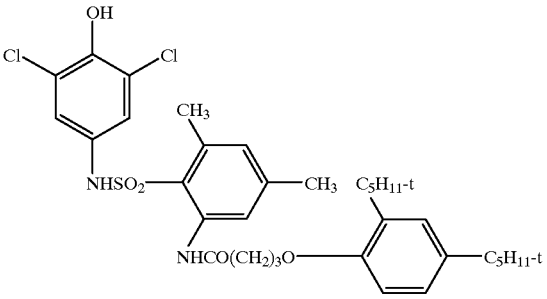
D-72
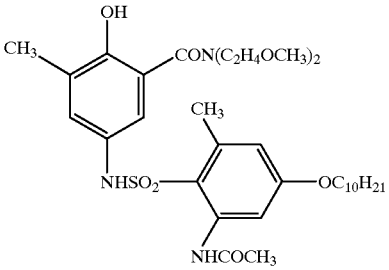

-continued
D-73
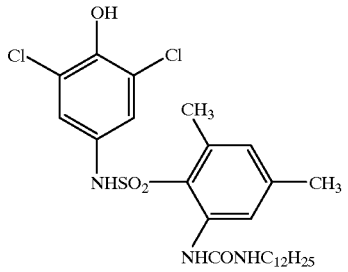
D-74
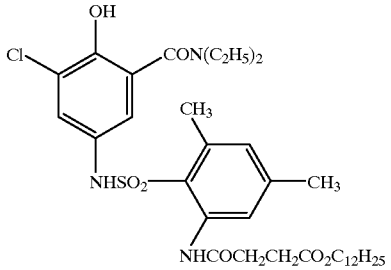
D-75
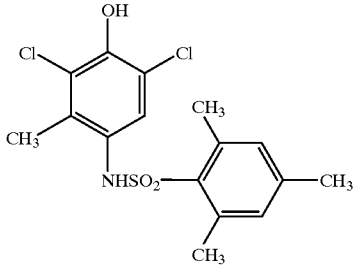
D-76
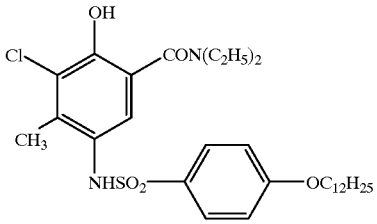
D-77
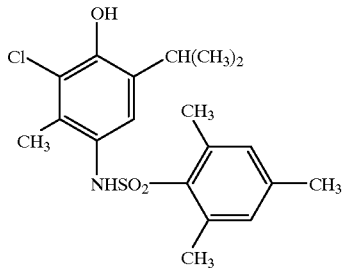

-continued
D-78
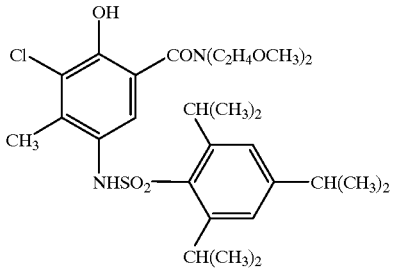
D-79
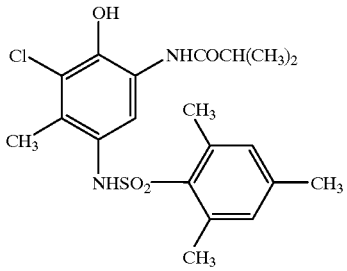
D-80
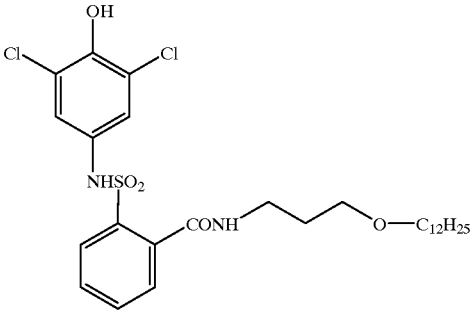
D-81
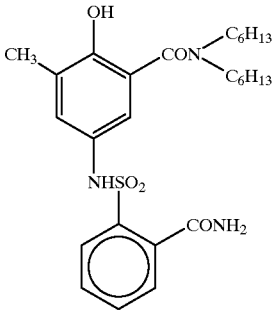
D-82
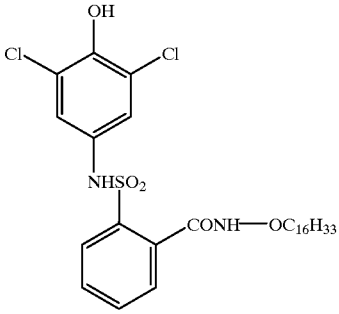

-continued
D-83
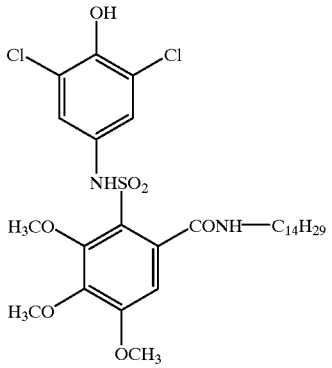
D-84
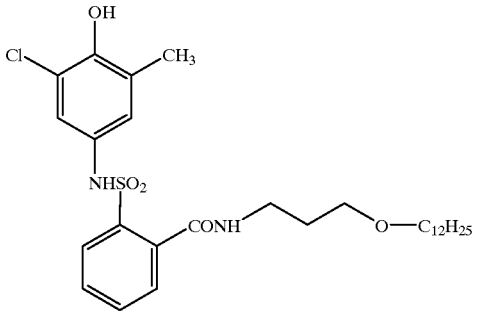
D-85
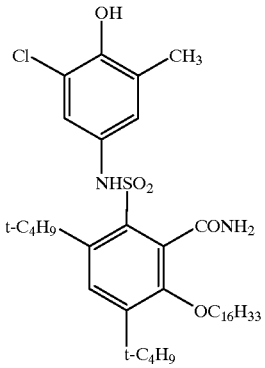
D-86
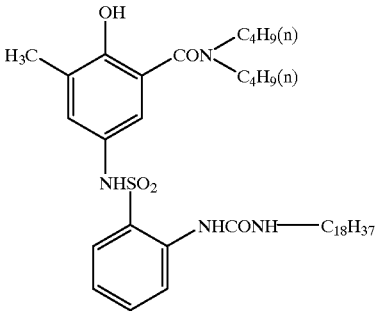

-continued
D-87
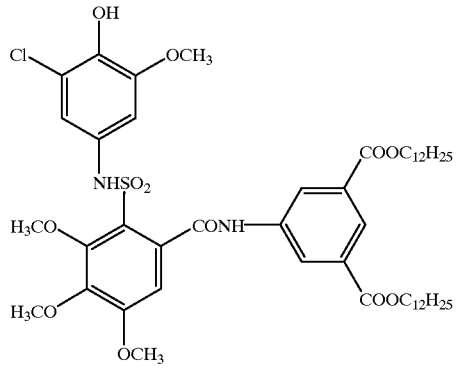
D-88
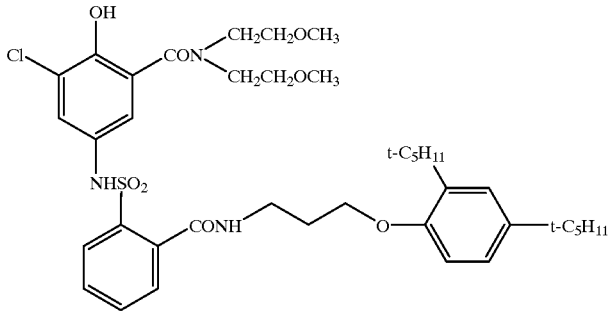
D-89
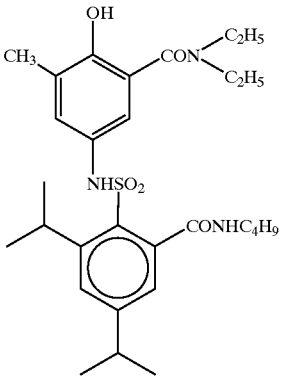
D-90
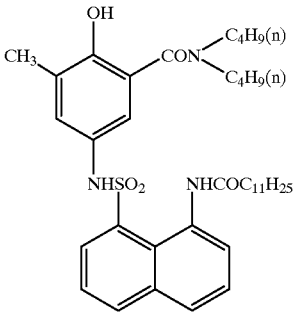

-continued
D-91
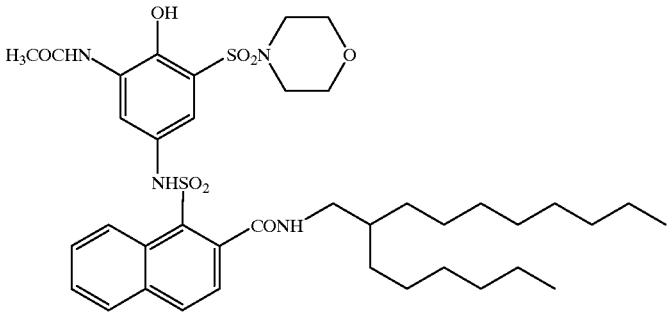
D-92
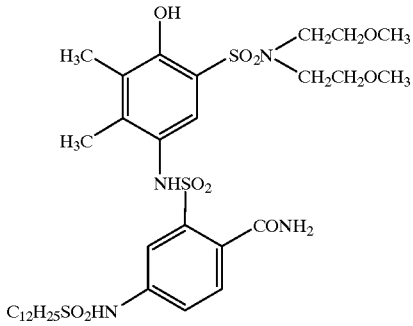
D-93
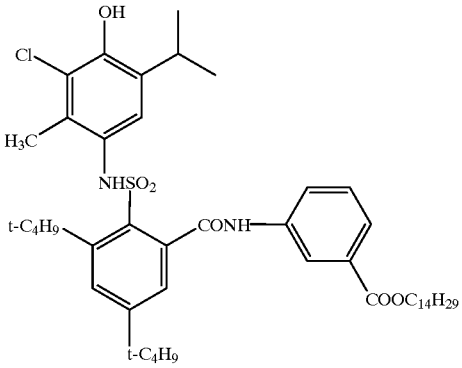
D-94
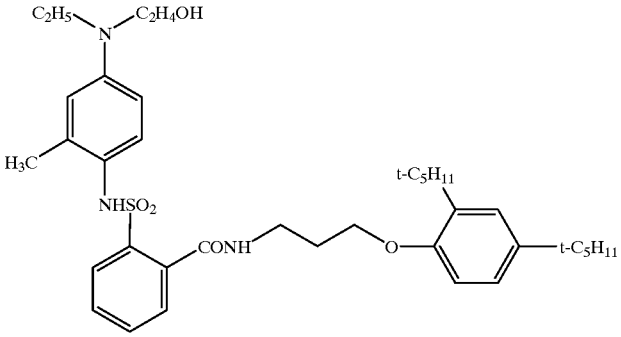

-continued
D-95
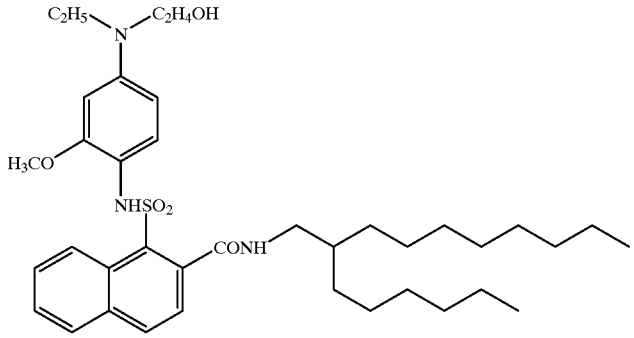
D-96
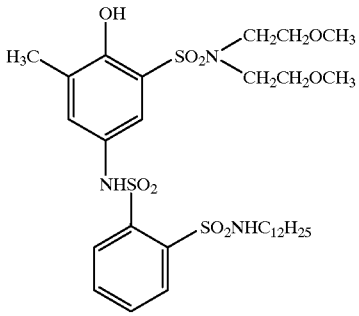
D-97
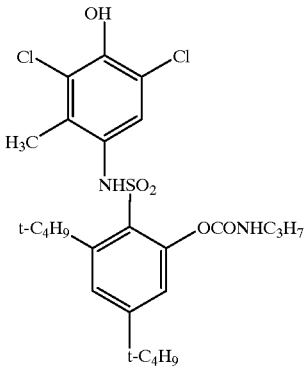
D-98
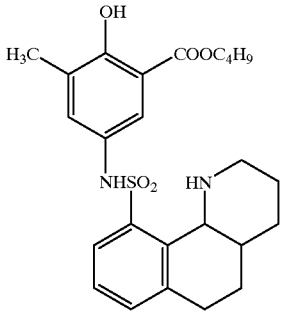

-continued
D-99
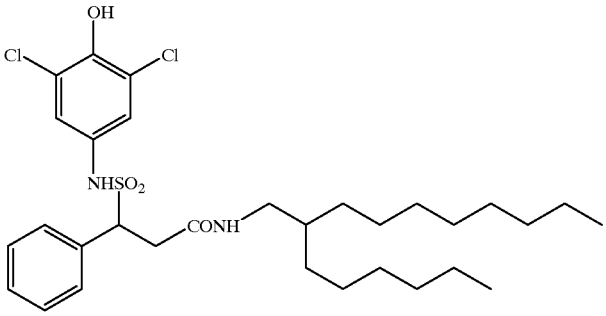
D-100
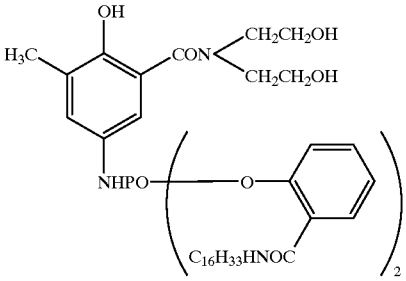
D-101
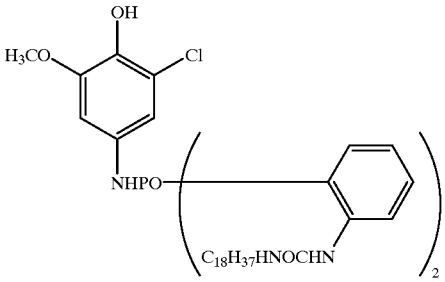
D-102
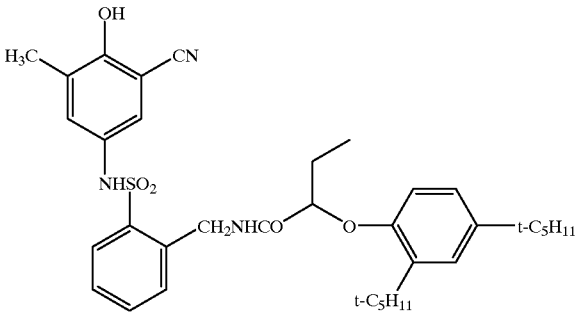
D-103
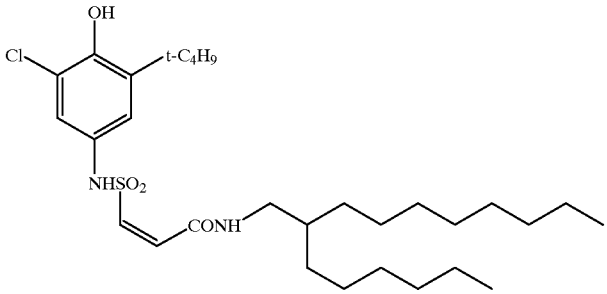

-continued
D-104
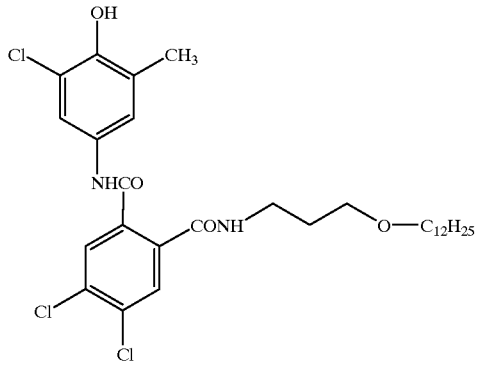
D-105
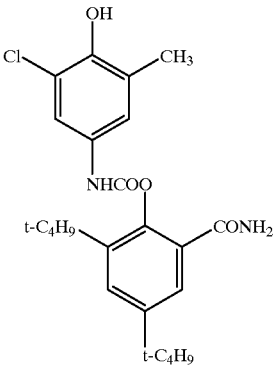
D-106
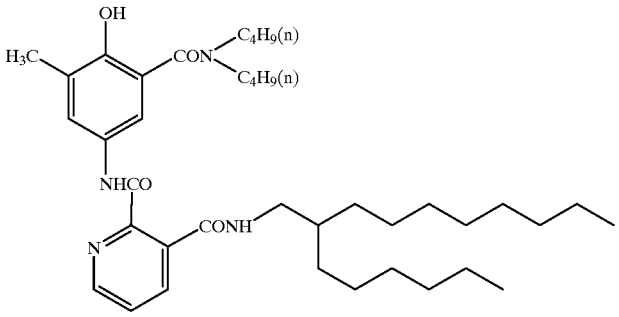
D-107
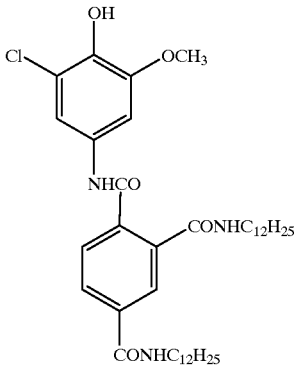

-continued
D-108
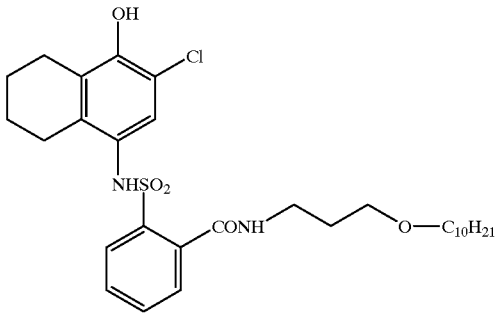
D-109
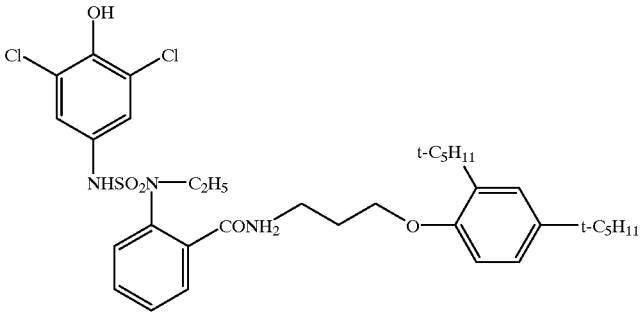
D-110
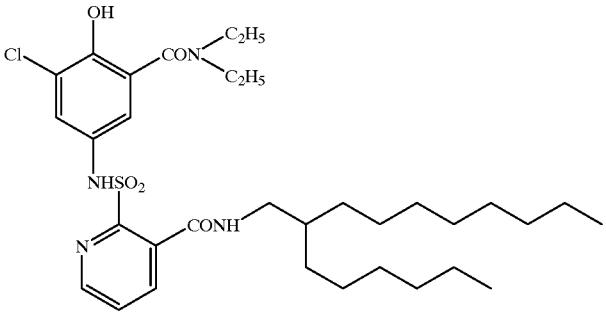
D-110
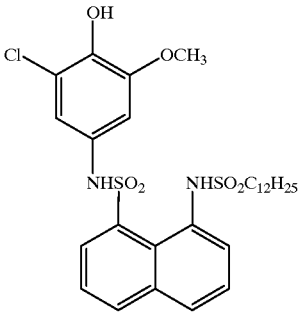
D-112
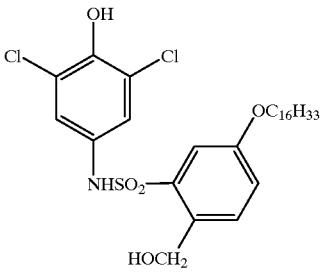

-continued
D-113
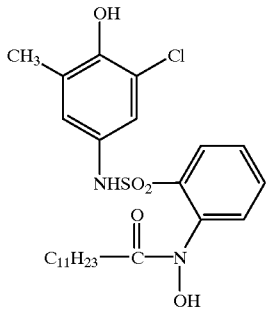
D-114
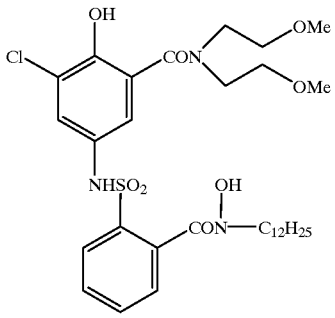
D-115
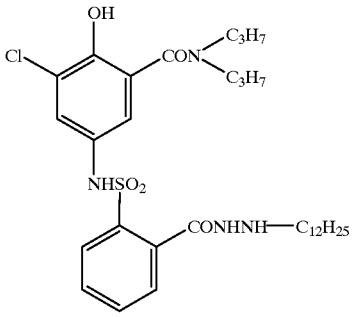
D-116
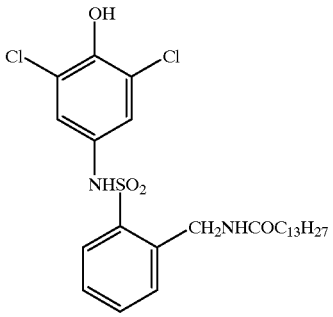

-continued
D-117
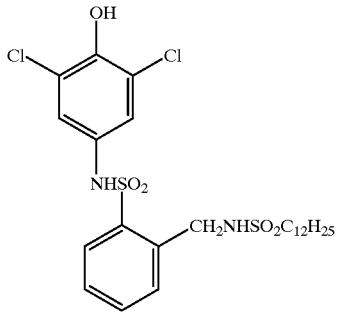
D-118
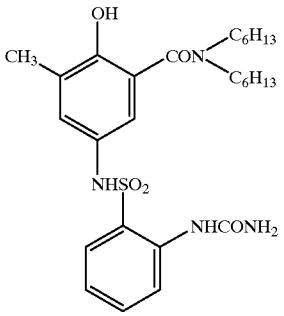
D-119
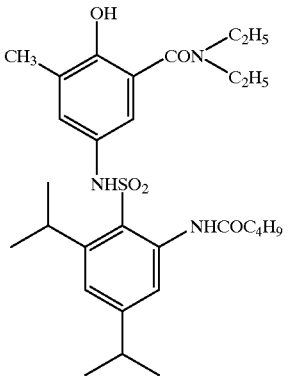
D-120
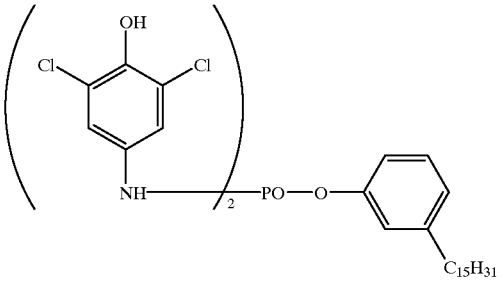

-continued
D-121
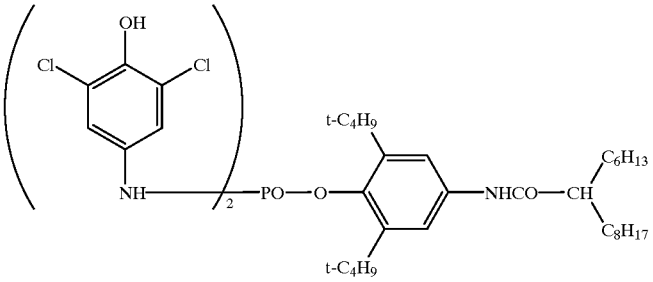
D-122
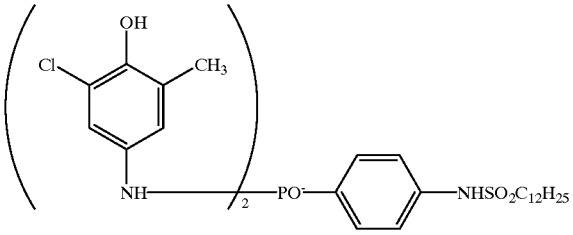
D-123
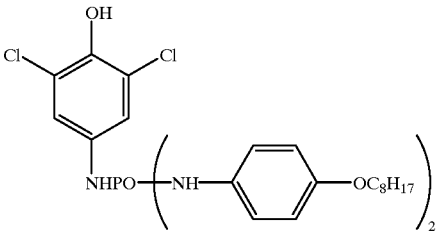
D-124
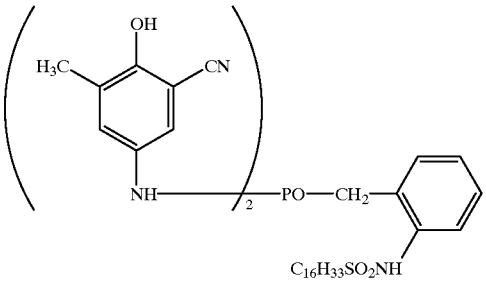
D-125
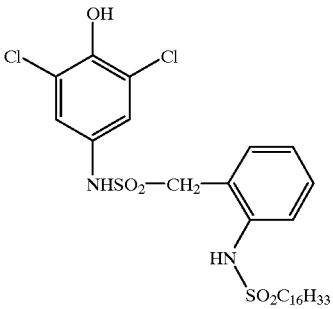

-continued
D-126
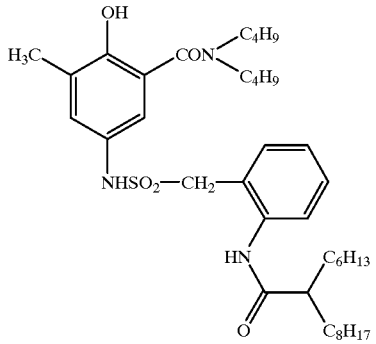
D-127
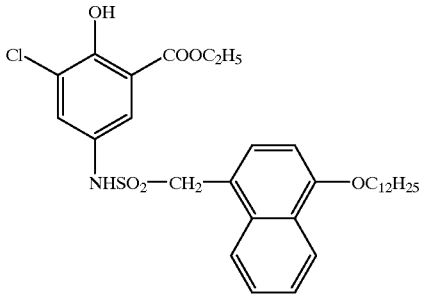
D-128
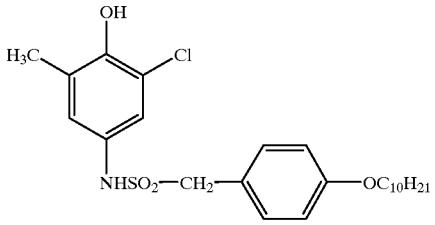
D-129
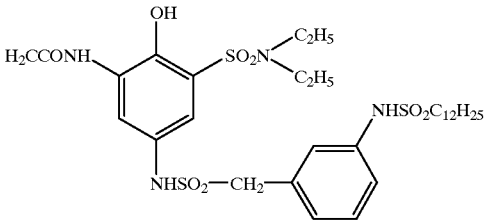
D-130
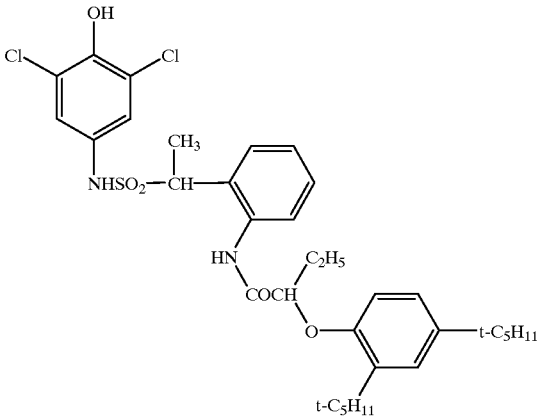

-continued
D-131
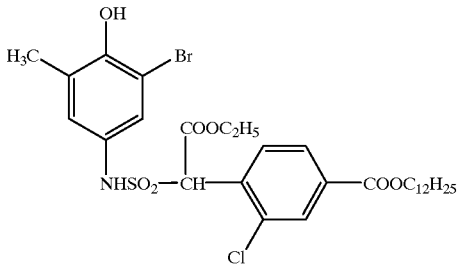
D-132
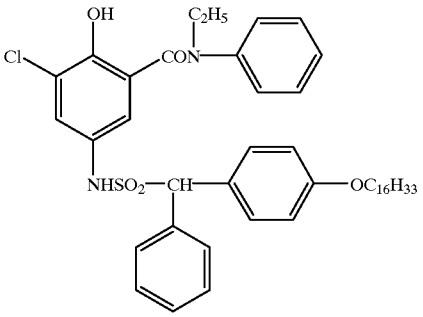
D-133
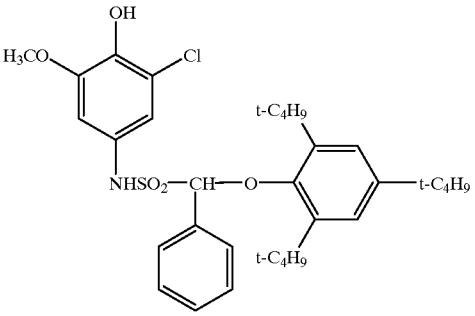
D-134
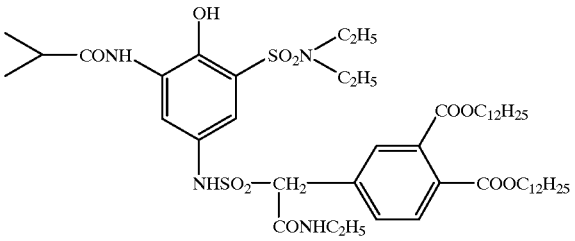
D-135
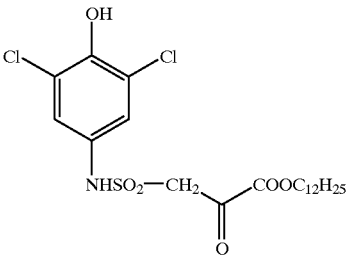

-continued
D-136
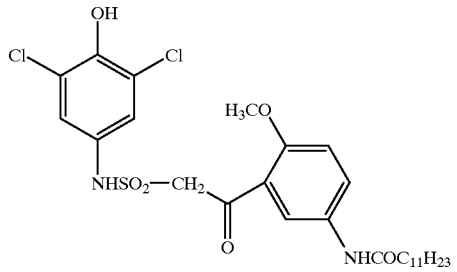
D-137
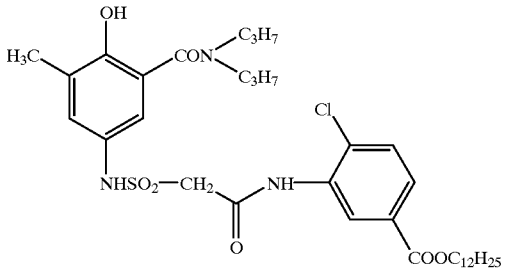
D-138
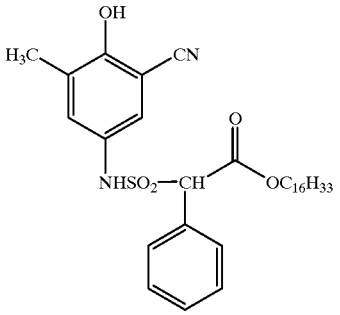
D-139
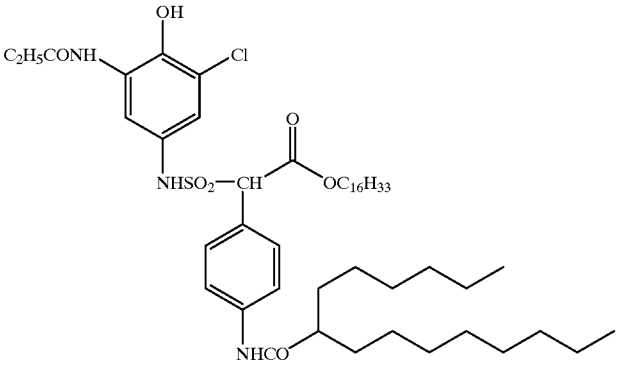
D-140
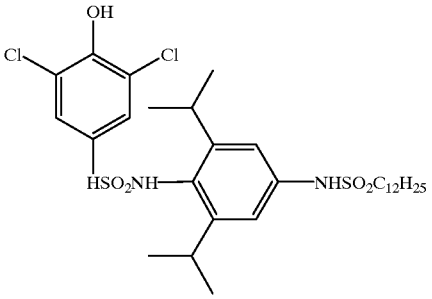

-continued
D-141
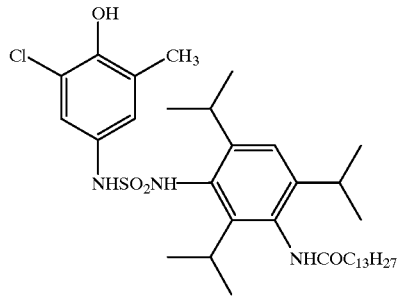
D-142
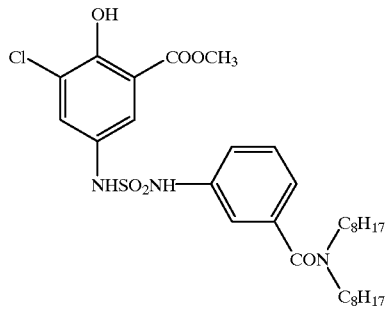
D-143
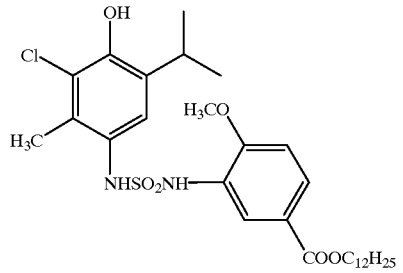
D-144
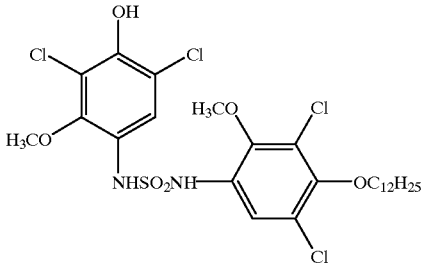
D-145
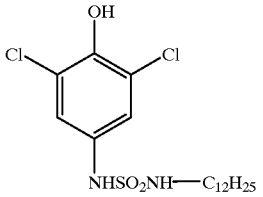

-continued
D-146
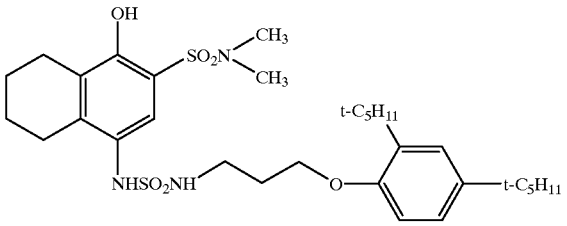
D-147
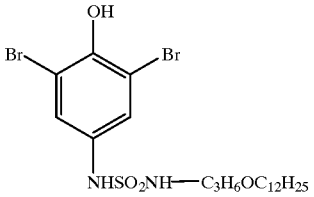
D-148
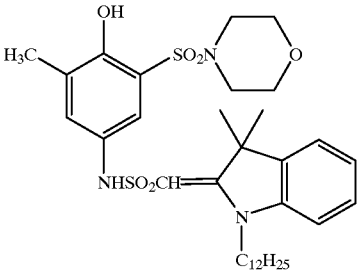
D-149
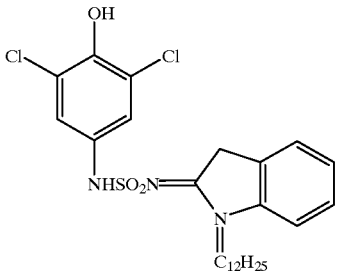
D-150
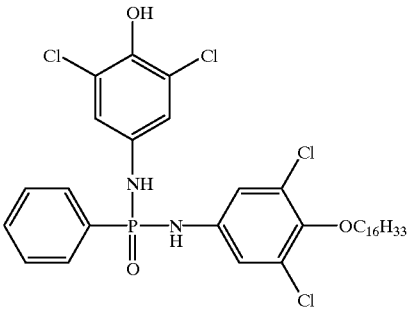

-continued
D-151
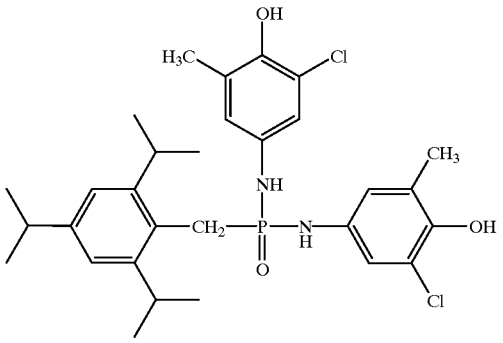
D-152
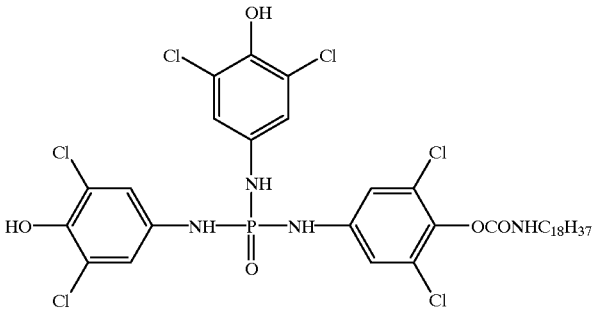
D-153
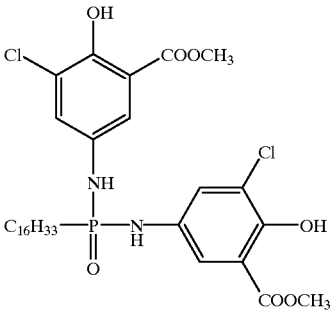
D-154
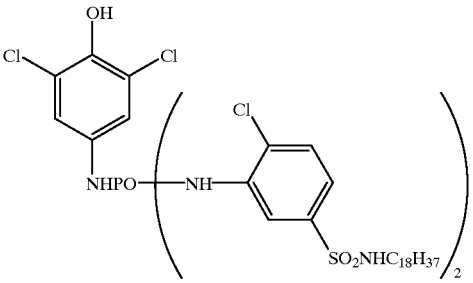
D-155
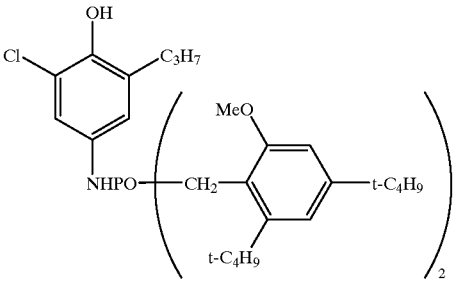

-continued

D-156

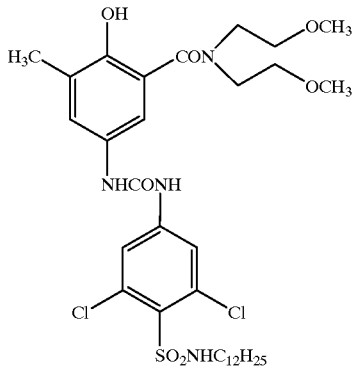

The color developing agent is any one of the above described compounds or a combination thereof. Different developing agents may be used in each layer. The total amount of the developing agents used is in a range of from 0.05 to 20 mmol/$m^2$, preferably from 0.1 to 10 mmol/$m^2$.

A coupler that forms a dye in a coupling reaction with an oxidized form of the color developing agent is used for a photosensitive material. As preferred examples, there can be named the following: compounds generally called an active methylene, 5-pyrazolone, pyrazoloazole, phenol, naphthol and pyrrolotriazole. As concrete examples, compounds quoted in *Research Disclosure*, Item 38957, pp. 616 to 624 (September, 1996) can be preferably employed. As especially preferable examples, there are named a pyrazoloazole coupler as described in Japanese Patent Application Laid-Open (JP-A) No. 8-110608 and a pyrrolotrizaole coupler described in Japanese Patent Application Laid-Open (JP-A) Nos. 8-122994; 9-218496 and the like.

These couplers are used in an amount per color in a range of from 0.05 to 10 mmol/$m^2$, preferably from 0.1 to 5 mmol/$m^2$.

Other compounds that can be employed include: a colored coupler used for correction of unnecessary absorption of a color former; a compound (including a coupler) releasing a photographically useful compound residual, such as a development inhibitor, through a reaction with an oxide form of the developing agent, and the like.

Hydrophobic additives such as the color developing agent and the coupler can be introduced into layers of the photosensitive element by means of well-known methods such as a method described in U.S. Pat. No. 2,322,027. In this case, a high-boiling point organic solvent as described in U.S. Pat. Nos. 4,555,470; 4,536,466; 4,536,467; 4,587,206; 4,555,476; 4,599,296; Japanese Patent Application Laid-Open (JP-A) No. 3-62256 and the like can be used along with a low-boiling point organic solvent with a boiling point in a range of from 50 to 160° C. if necessary. The amount of the high-boiling point organic solvent is 10 g or less, preferably 5 g or less, or more preferably 1 g to 0.1 g, per 1 g of the hydrophobic additive in use.

A solid-phase dispersion method described in Japanese Patent Application Laid-Open (JP-A) No. 63-271339 can used to introduce the additives.

When the processing element of the present invention includes a neutralizing agent and neutralization of the photosensitive element after developing processing is performed with the neutralizing agent, it is preferable that a compound represented by the general formula (9) is incorporated in the photosensitive element in a mixture with the above-described high-boiling point organic solvent. It has been found that a dye produced thereby stays in a stable dissociated state and that reduction in color forming ability does not arise, even when the photosensitive element is neutralized.

The amount of a compound represented by the general formula (9) is equal to or more than the equivalent amount in moles of the coupler and the total amount of the high-boiling point organic solvent described above is preferably in a range of from ⅓ to 3 times the weight of the coupler. A total amount of a compound represented by the general formula (7) can be used singly in place of the above described high-boiling organic solvents.

Compounds represented by the general formula (9) will be detailed below.

Each of $R_{11}$ and $R_{12}$ independently represents a hydrogen atom, an aliphatic group (preferably, an alkyl group or an alkenyl group which may have an substituent with 1 to 40 carbon atoms and which can be exemplified by the following: a methyl group; an ethyl group; an i-propyl group; a t-butyl group; a dodecyl group, a 4-(2, 4-di-t-pentylphenoxy)butyl group; a 3-(3-dodecyloxyphenylcarbamoyl)propyl group; a 2-hexyldecyl group; a cyclohexyl group; a 2-phenethyl group; a benzyl group; a 3-dioctylaminopropyl group; an allyl group; or an 8-octadecenyl group), or an aryl group (preferably, a phenyl group which may have an substituent with 6 to 36 carbon atoms and which can be exemplified as: a phenyl group; a 4-dodecyloxyphenyl group; or a 3-chlorophenyl group). $R_{13}$ is an aliphatic group (preferably, an alkyl group or an alkenyl group which may have a substituent with 1 to 40 carbon atoms and which can be exemplified by the following: a methyl group; an ethyl group; an i-propyl group; a t-butyl group; a dodecyl group, a 4-(2, 4-di-t-pentylphenoxy)butyl group; a 3-(3-dodecyloxyphenylcarbamoyl) propyl group; a 2-hexyldecyl group; a cyclohexyl group; a 2-phenethyl group; a benzyl group; a 3-dioctylaminopropyl group; an allyl group; or an 8-octadecenyl group), or a group represented by the general formula (Ab).

$R_{14}$ is a hydrogen atom, an aliphatic group (preferably, an alkyl group or an alkenyl group which may have an substituent with 1 to 40 carbon atoms and which can be exemplified by the following: a methyl group; an ethyl group; an i-propyl group; a t-butyl group; a dodecyl group; a 4-(2,4-di-t-pentylphenoxy)butyl group; a 3-(3-dodecyloxyphenylcarbamoyl)propyl group; a 2-hexyldecyl group; a cyclohexyl group; a 2-phenethyl group; a benzyl group; a 3-dioctylaminopropyl group; an allyl group; or an 8-octadecenyl group), or an aryl group (preferably, a phenyl group which may have an substituent with 6 to 36 carbon atoms and which can be exemplified by the following: a phenyl group; a 4-dodecyloxyphenyl group; or a 3-chlorophenyl group).

$R_{15}$ is a hydrogen atom, an aliphatic group (preferably, an alkyl group or an alkenyl group which may have an substituent with 1 to 40 carbon atoms and which can be exemplified by the following: a methyl group; an ethyl group; an i-propyl group; a t-butyl group; a dodecyl group; a 4-(2, 4-di-t-pentylphenoxy)butyl group; a 3-(3-dodecyloxyphenylcarbamoyl)propyl group; a 2-hexyldecyl group; a cyclohexyl group; a 2-phenethyl group; a benzyl group; a 3-dioctylaminopropyl group; an allyl group; or an 8-octadecenyl group), an aryl group (preferably, a phenyl group which may have an substituent with 6 to 36 carbon atoms and which can be exemplified by the following: a phenyl group; a 4-dodecyloxyphenyl group; or a 3-chiorophenyl group), or an amino group (preferably, an amino group which has a substituent with 1 to 50 carbon atoms, which may form a heterocycle through coupling between two substituents on a nitrogen atom in a case of N, N-di-substitution, and which can be exemplified by the following: an anilino group; a dioctylamino group, an N-ethylanilino group or a piperidyl group).

$R_{11}$ and $R_{12}$, $R_{11}$ and $R_{13}$, $R_{12}$ and $R_{13}$, and $R_{14}$ and $R_{15}$ may respectively form 5, 6 or 7-elemented rings (for example, a piperazine ring, a piperidine ring, a pyrrolidine and a homopiperazine ring). The total number of carbon atoms in $R_{11}$ , $R_{12}$ and $R_{13}$ is 10 or more and at least one of $R_{11}$ and $R_{12}$ is an aliphatic group. Further, when one of $R_{11}$ and $R_{12}$ is an aryl group, $R_{13}$ is a group represented by the general formula (Ab)

In the present invention, $R_{11}$ and $R_{12}$ preferably each represent an aliphatic group from a standpoint of maintaining color forming ability when neutralization is conducted. The total number of carbon atoms in $R_{11}$, $R_{12}$ and $R_{13}$ is preferred to be 18 or more, more preferably in a range of from 20 or more to 80 or less. Further, preferable examples of a substituent that may be a substituent of an aliphatic group of any of $R_{11}$ to $R_{15}$ include: a carbamoil group; an alkoxy group; an aryloxy group; an aryl group; a sulfonyl group; an acylamino group; an alkylamino group; and a heterocyclic group.

Next, concrete examples of the compounds represented by the general formula (9) given however, it should be noted that the present invention is not restricted by the following compounds:

(1)

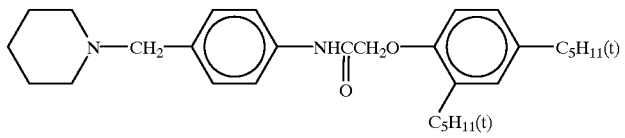

(2)

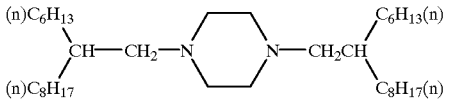

(3)

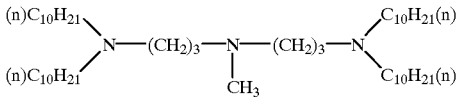

(4)

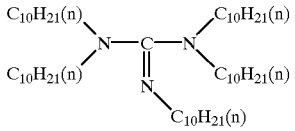

(5)

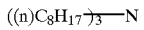

(6)

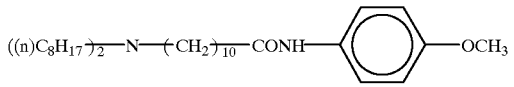

(7)

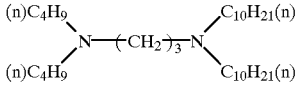

-continued
(8)
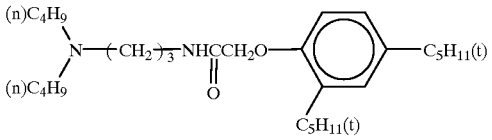
(9)
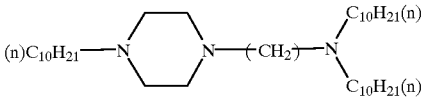
(10)
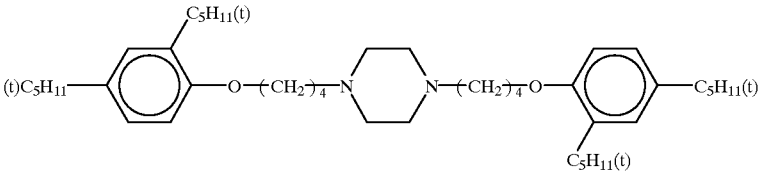
(11)
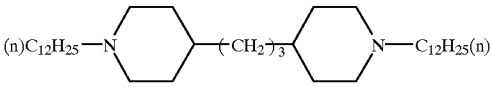
(12)
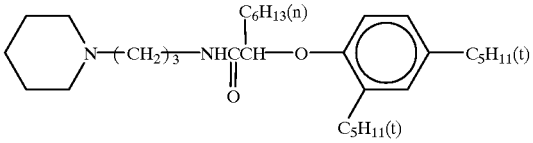
(13)
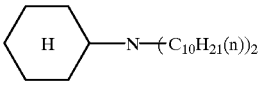
(14)
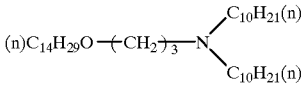
(15)
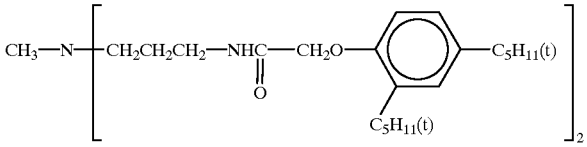
(16)
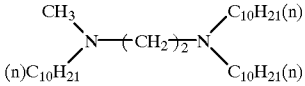
(17)
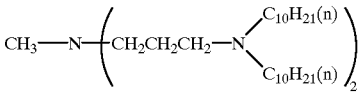

-continued
(18)
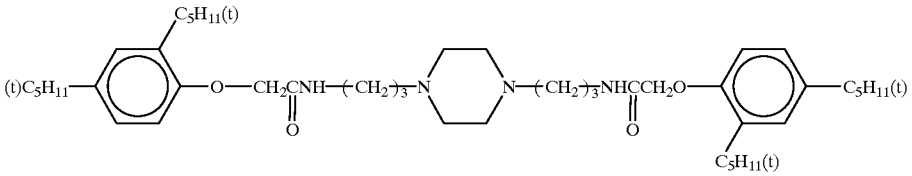
(19)
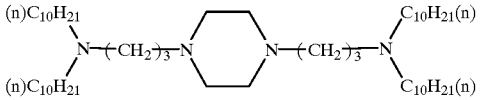
(20)
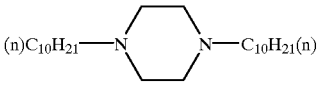
(21)
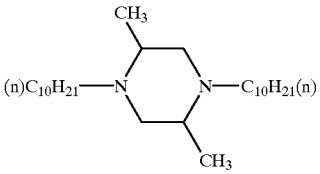
(22)
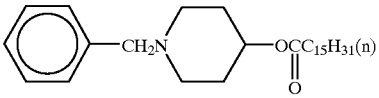
(23)
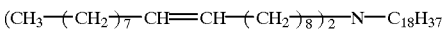
(24)
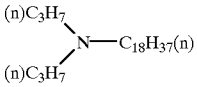
(25)
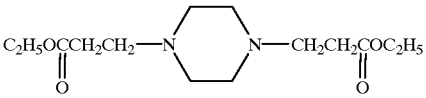
(26)
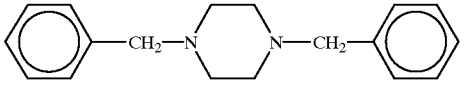
(27)
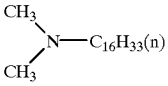
(28)
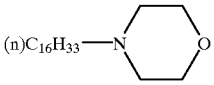
(29)
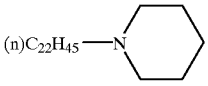

-continued
(30)
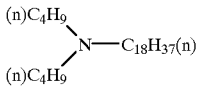
(31)
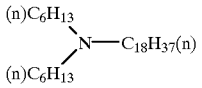
(32)
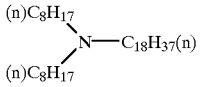
(33)
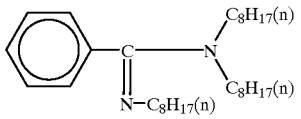
(34)
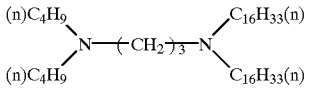
(35)
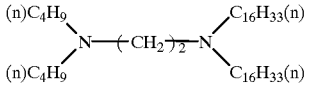
(36)
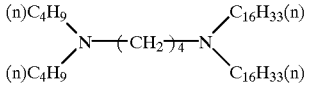
(37)
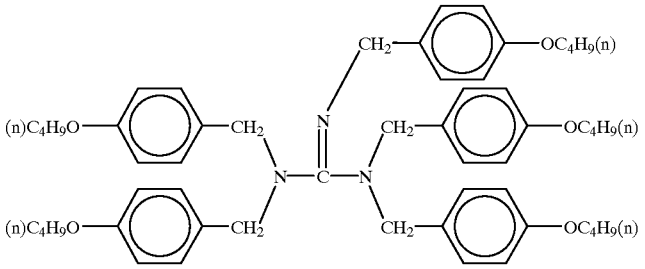
(38)
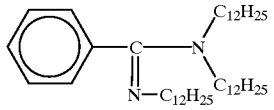
(39)
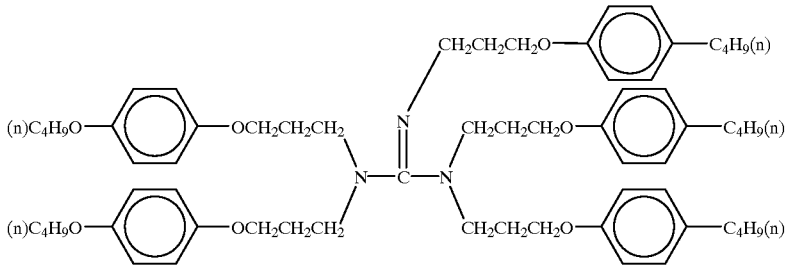

-continued
(40)
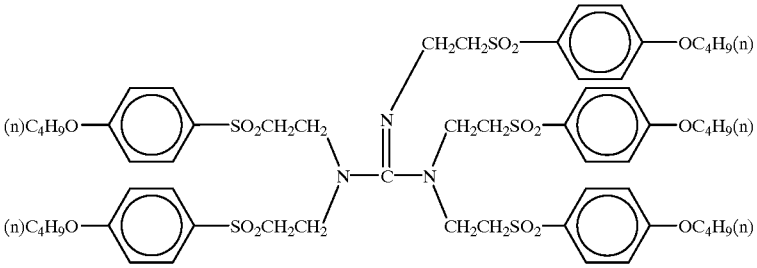
(41)
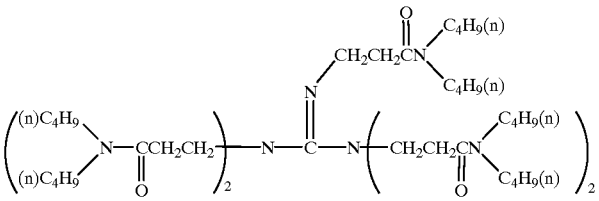
(42)
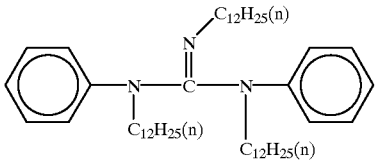
(43)
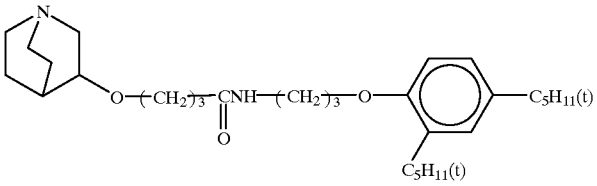
(44)
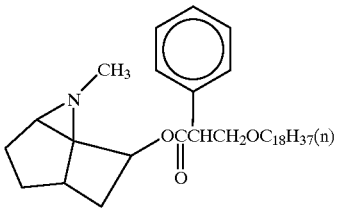
(45)
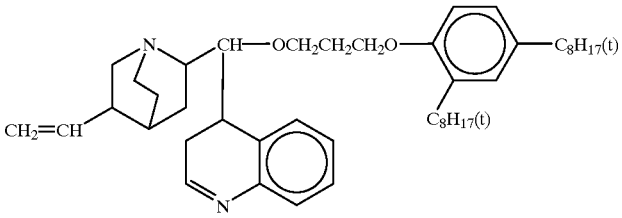

-continued
(46)
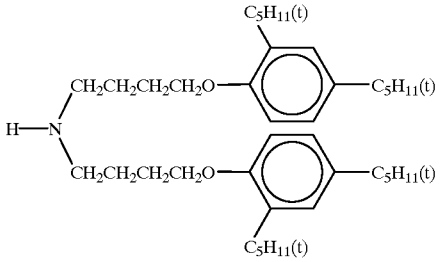
(47)
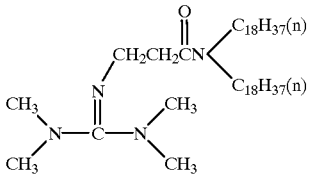
(48)
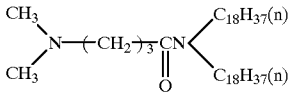
(49)
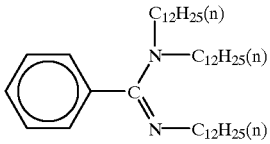
(50)
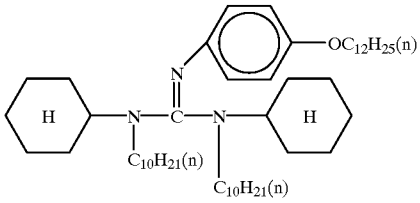
(51)
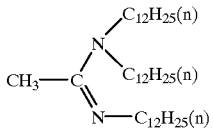
(52)
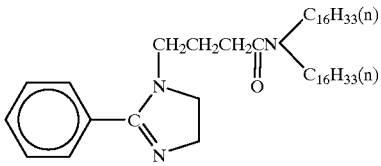
(53)
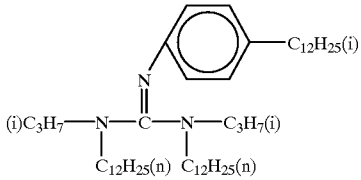

-continued (54)

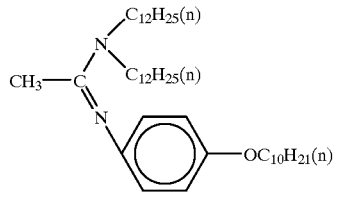

(55)

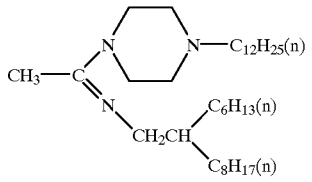

(55)

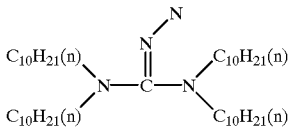

These compounds can be synthesized through a reaction between a primary amine or a secondary amine and an alkyl halide, through a reduction reaction of an amide compound or based on a method described in "New Experimental Chemistry Lecture", vol. 14–3, p. 1608, (1978) Tokyo. Below is a synthesis example of a typical compound. Synthesis of an exemplified compound (2)

Thionyl chloride (40 ml) was added to 2-hexyldecanic acid (41.0 g) and the solution was heated for 1 hour while refluxing. After excess thionyl chloride was removed by distillation under reduced pressure, piperazine (6.8 g), dimethyl acetoamide (50 ml), ethyl acetate (100 ml) and triethyl amine (25 ml) were added dropwise to the solution over 10 minutes at a temperature between 15° C. to 20° C. while stirring the solution. The reaction solution was poured into 200 ml of cold water and subjected to extraction with 100 ml of ethyl acetate. An ethyl acetate layer was washed with 200 ml of saturated salt water twice, and dried with anhydrous magnesium sulfate. Thereafter the solvent was removed by distillation under reduced pressure. An oily material obtained after distillation was refined by means of silica-gel chromatography to obtain an oily intermediate (41.0 g). Lithium hydride (2.4 g) was added to 20 ml of tetrahydrofuran, and the oily material (11.2 g) was added dropwise to the solution over 5 minutes at a temperature between 15° C. and 20° C. while stirring the solution. The heating and stirring were continued for another 30 minutes, and, thereafter temperature of the solution was lowered to a temperature between 25° C. to 30° C. Next ethyl acetate (20 ml) and water (50 ml) were slowly added dropwise to the solution and the solution was subjected to extraction with ethyl acetate (100 ml). A ethyl acetate layer was washed with 100 ml of saturated salt water and dried with anhydrous magnesium sulfate, and the solvent was removed by distillation under reduced pressure. An oily material obtained after the distillation was refined by alumina-column chromatography to obtain a viscous colorless liquid. An obtained compound was subjected to identification tests and confirmed to be an exemplified compound (2) by mass spectra, NMR spectra, and infrared absorption spectra (8.9 g produced with a yield of 83.6% based on the oily intermediate)

The photosensitive element that can be treated by the processing element of the present invention is one of a structure in which a photosensitive silver halide emulsion layer is formed on a substrate. The photosensitive material may be a black and white silver halide photosensitive material with which a silver image is obtained as a final image, but the processing element of the present invention is especially preferred for treatment of silver halide color-photography photosensitive materials with which a color image made from dyes is obtained as a final image.

A photosensitive member that creates a color image has a structure formed with three or more photosensitive layers each with a different kind of color sensitivity. Each photosensitive layer includes at least one silver halide emulsion layer and, in a typical case, is substantially formed with a plurality of silver halide layers each with a different photosensitivity, although the color sensitivities are same. Each of the photosensitive layers is ordinarily a unit photosensitive layer sensitive to one of blue light, green light and red light. In a multi-layer silver halide color-photography photosensitive material, the arrangement of the unit photosensitive layers is generally in the following order: starting with a substrate, a red color sensitive layer, a green color sensitive layer and then a blue color layer. However, the arrangement order can be reversed according to the purposes of application and besides, different photosensitive layers can be inserted in the same color sensitive layer.

The total thickness of a set of the photosensitive layers is in a range of from 1 to 20 $\mu$mn, preferably from 3 to 15 $\mu$m.

In the present invention, as colored layers in which is used oil-soluble dyes that can be decolored by a treatment, a yellow filter layer, amagenta filter layer and an anti-halation layer can be employed. By employing such colored layers, the following, for example, are possible: when photosensitive layers are arranged in an order where a red-sensitive layer is positioned at a position-closest to the substrate, a green-sensitive layer at a farther position and a blue-sensitive layer at a still farther position, the yellow filter layer can be inserted between the blue-sensitive layer and the green-sensitive layer, the magenta filter layer between the green-sensitive layer and the red-sensitive layer and a cyan filter layer (the anti-halation filter layer) between the red-sensitive layer and the substrate. The colored layers may be directly placed in contact with the emulsion layer or layers, or may be indirectly placed in contact with the emulsion or emulsions with an intermediate layer such as a gelatin layer or the like interposed therebetween. The amounts of dyes used are controlled in such a manner that transmission densities of the layers all fall in a range of from 0.03 to 3.0, preferably from 0.1 to 1.0, for each of the blue, green and red colors. In a concrete manner, while the amounts are dependent on the E values and molecular weights of the dyes, the amounts may be in a range of from 0.005 to 2.0 mmol/$m^2$, more preferably from 0.05 to 1.0 mmol/$m^2$.

As dyes to be used, the following are preferable: compounds each having a structure composed of a methine group and two selected from the group consisting of: acidic nuclei which is cyclic ketomethylene compounds described in Japanese Patent Application Laid-Open (JP-A) No. 10-207027 (for example, 2-pyrazoline-5-one, 1, 2, 3, 6-tetrahydropyridine-2, 6-dione, rhodanine, hydantoin, thiohydantoin, 2, 4-oxazolidinedione, iso-oxazolone, barbituric acid, thiobarbituric acid, indandione, dioxopyrazolopyridine, hydroxypyridine, pyrazolidinedione, 2, 5-dihydrofuran-2-one and pyrroline-2-one) or a compound having a methylene group sandwiched by an electron attractive group, for example: a methylene group sandwiched by —CN, $—SO_2R_{21}$, $—COR_{21}$, $—COOR_{21}$, $CON(R_{22})_2$, $—SO_2N(R_{22})_2$, $—C[=C(CN)_2]R_{21}$, $—C[=C(CN)_2]N(R_{21})_2$, wherein $R_{21}$ represents an alkyl group, an alkenyl group, an aryl group, a cycloalkyl group or a heterocyclic group and $R_{22}$ represents a hydrogen atom or a group represented by $R_{21}$; basic nuclei (for example, pyridine, quinoline, indolenine, oxazole, imidazole, thiazole, benzoxazole, benzoimidazole, benzothiazole, oxazoline, naphthoxazole, pyrrole); aryl groups (for example, a phenyl group and a naphthyl group); and heterocyclic groups (for example, pyrrole, indole, furan, thiophene, imidazole, pyrazole, indolizine, quinoline, carbazole, phenothiazine, phenoxazine, indoline, thiazole, pyridine, pyridazine, thiazine, pyran, thipyran, oxadiazole, benzoquinoline, thiadiazole, pyrrolothiazole, pyrrolopyridazine, tetrazole, oxazole, coumarine, coumarone); and $(NC)_2C=C(CN)-R_{23}$ ($R_{23}$ represents an aryl group or a heterocyclic group).

Two or more dyes may be used in one colored layer of a photosensitive element. For example, three kinds of dyes i.e., yellow, magenta and cyan, can be incorporated as a mixture in the anti-halation layer.

A chromatic dyes are preferably used in a dispersed state in a hydrophilic binder as oil particles by being dissolved in oil and/or an oil-soluble polymer. As a preparation method for the achromatic dye in a dispersed state, an emulsification dispersing method is preferred. For example, a method which is described in U.S. Pat. No. 2,322,027 can be employed. In this case, a high-boiling point oil as described in U.S. Pat. Nos. 4,555,470; 4,536,466; 4,587,206; 4,555,476; 4,599,296; Japanese Patent Application Publication (JP-B) No.3-62256; and the like can be used. A low boiling point organic solvent with a boiling point in a range of from 50° C. to 160° C. can be jointly used as necessary. Further, a mixture composed of two or more kinds of high-boiling point oils can be used. A oil-soluble polymer can also be used instead of oil or in combination with oil; examples of this case are described in the specification of PCT International Publication No. WO 88/00723. The amount of the high boiling point oil and/or the polymer to be used is in a range of from 0.01 g to 10 g, preferably from 0.1 g to 5 g, per 1 g of a dye.

As a method of dissolving the dye in the polymer, a latex dispersion method can be employed, and a process and a concrete example of a latex for immersion are described in U.S. Pat. No. 4,199,363; German Patent Specification publications (OLS) Nos. 2,541,274; and 2,541,230; Japanese Patent Application Publication (JP-B) No. 53-41091; European Patent Specification publication No. 029104 and the like.

When oil particles are dispersed in a hydrophilic binder, various kinds of surfactants can be employed. For example, surfactants described in Japanese Patent Application Laid-Open (JP-A) No. 59-157636, pp. 37 and 38; and "Publicly Known Techniques," No. 5, pp. 136 to 138 (March 22, 1991) published by Aztech Co. Ltd., Tokyo, can be used. A phosphate type surfactant described in Japanese Patent Application Laid-Open (JP-A) Nos. 7-56267; 7-228589; and German Patent Specification Publication No. 3,932,288A can be used.

As the hydrophilic binder, a water-soluble polymer is preferably used. As examples, there can be named: gelatin and a protein that is a gelatin derivative; natural compounds, for example polysaccharides such as a cellulose derivative, starch, gum arabic, dextran, purlan and the like; synthetic high polymer compounds such as a polyvinyl alcohol, a polyvinyl pyrrolidone and an acrylamide polymer. These water-soluble polymers can also be used in a combination of two or more kinds. Especially, a combination having gelatin as one component is preferred. The gelatin is only required to be selected from the group consisting of lime-treated gelatin, acid-treated gelatin, deliming gelatin (the content of calcium and the like of which is reduced) and mixtures thereof.

The dye is decolored in a treatment in the presence of an achromatizing agent.

As the achromatizing agent, the following examples can be named: alcohols or phenols; amines or anilines; sulfinic acids or salts thereof; sulfurous acid or salts thereof; thiosulfuric acid or salts thereof; carboxylic acids or salts thereof; hydrazines; guanidines; aminoguanidines; amidines; thiols; cyclic or straight chain active methylene compounds; cyclic or straight chain active methyne compounds; anion species formed with these compounds; and the like.

Compounds preferably used among these are hydroxyl amines, sulfinic acids, sulfurous acid, guanidines, aminoguanidines, heterocyclic thiols, cyclic or straight chain active methylene and active methyne compounds. Among these, guanidines and aminoguanidines are especially preferred.

It is considered that the above described achromatizing agents decolor a dye by being put in contact with the dye in the treatment and decolor a dye molecule through nucleophilic addition. It is preferred that the silver halide photosensitive material containing a dye is superposed on the processing element containing the achromatizing agent or a precursor of the achromatizing agent so that the respective films are layered upon each other in the presence of a small amount of water and the superposed composite is heated after imagewise exposure or at the same time as the imagewise exposure. Further, both elements in the superposed composite are separated from each other thereafter. Thereby, not only is a color image obtained on the silver halide photosensitive material, but the dye is decolored. In this case, the density of the dye after achromatization is reduced to be ⅓ or less, preferably ⅕ or less, of the original density.

The amount of the achromatizing agent used is in a range of from 0.1 to 200, preferably from 0.5 to 100, times the amount of the dye in moles.

Silver halide, the color developing agent and the coupler may be included in the same photosensitive layer or in different layers. Non-photosensitive layers such as a protective layer, an undercoat layer and an intermediate layer, and the yellow filter layer, and the anti-halation layer and the like described above may be provided in addition to the photosensitive layers. A back layer may be provided at the reverse side of the substrate as well. The total thickness of all of the coated films on the photosensitive layer side is in a range of from 3 to 25 $\mu$m, preferably from 5 to 20 $\mu$m.

In a photosensitive material, the following can be used, for various purpose: a hardener, a surfactant, a photograph-stabilizing agent, an antistatic agent, a lubricant agent, a matting agent, latex, a formalin scavenger, a dye, a UV absorbent and the like. Concrete examples of these materials are described in Research Disclosure and in Japanese Patent Application Laid-Open (JP-A) No. 9-204031 and the like. Especially preferable examples of the antistatic agent are fine particles of metal oxides such as ZnO, $TiO_2$, $SnO_2$, $Al_2O_3$, $In_2O_3$, $SiO_2$, MgO, BaO, $MoO_3$, $V_2O_5$ and the like.

As the substrate for the photosensitive material, photographic substrates described in "Fundamentals of Photographic Engineering—on silver salt photography" compiled by the Japan Photographic Society, pp. 223 to 240, published by K. K. Corona, Tokyo (the 54th year of the Show area). In a concrete manner, there are listed as examples: polyethylene terephthalate, polyethylene naphthalate, polycarbonate, syndiotactic polystyrene, celluloses (for example, triacetyl cellulose) and the like.

A polyester containing polynaphthalate as the major ingredient is especially preferred among these, but this "polyester containing polynaphthalate as a major ingredient" taken up here, is preferred to have naphthalenedicarboxylic acid included amongst dicarboxylic acid residues such that naphthalenedicarboxylic acid is contained at a percentage of 50 mole % or more, more preferably 60 mole % or more, or even more preferably 70mole %, of all thedicarboxylic acid residues. The polyester may be either a copolymer or a polymer blend.

In the case of the copolymer, the copolymer is preferably a copolymer in which naphthalenedicarboxylic acid units are polymerized with units such as terephthalic acid, bisphenol A, cyclohexanedimethanol and the like in addition to a case where naphthalenedicarboxylic acid units are polymerized with ethylene glycol units being preferable. A copolymer with terephthalic acid units is most preferable from a standpoint of mechanical strength and cost.

As preferable partners for the polymerblend, the following examples can be listed: polyesters such as polyethylene terephthalate (PET), polyarylate (PAr), polycarbonate (PC), and polycyclohexanedimethanolterephthalate (PCT),but among these, a polymer blend with PET is most preferable from the standpoint of mechanical strength and cost.

Below, concrete examples of preferred polyesters are listed.

Examples of polyester copolymers (figures in parentheses show mole ratios)

2, 6-naphthalenedicarboxylic acid/terephthalic acid/etyleneglycol (70/30/100) Tg=98° C.

2, 6-naphthalenedicarboxylic acid/terephthalic acid/etyleneglycol (80/20/100) Tg=105° C.

Examples of polyester polymer blends (figures in parentheses show mole ratios)

PEN/PET (60/40) Tg=95° C.

PEN/PET (80/20) Tg=104° C.

The following may be carried out with respect to the substrate, in order to improve optical and physical characteristics: a heat treatment (degree of crystallization, orientation control), uniaxial and biaxial drawings (orientation control), blending of various kinds of polymers, surface treatment and the like.

As the substrate, a substrate having a magnetic recording layer described in Japanese Patent Application Laid-Open (JP-A) Nos. 4-124645, 5-40321, 6-35092 and 6-31875, for example, is preferably used to record photographic information and the like.

A waterproof polymer as described in Japanese Patent Application Laid-Open (JP-A) No.8-292514 is preferably applied on a backside surface of the substrate for the photosensitive material.

Polyester substrates which are especially preferably used in the photosensitive material having the above described magnetic recording layer are in detail described in *Journal of Technical Disclosure* 94-6023 (Japan Institute of Invention and Innovation, Mar. 15, 1994).

The thickness of the substrate is in a range of from 5 to 200 $\mu$m, preferably 40 to 120 $\mu$m.

In an image-forming method of the present invention, developing processing of the photosensitive element may be a method in which an ordinary developer is employed or a method in which a developing agent is included in the photosensitive element and the photosensitive element is treated with an alkaline activator. However, in the present method, an especially preferable method for developing the photosensitive element that has already been used in taking a photograph is a method that employs a developing processing element having a processing layer including at least a base and/or a base precursor on a substrate.

As the base, an inorganic or organic base can be used. As the inorganic base, there can be listed as examples the following: hydroxides, phosphates, carbonates, borates and organic acid salts of alkali metals or alkali earth metals, described in Japanese Patent Application Laid-Open (JP-A) No. 62-209448; and acetylides of alkali metals or alkali earth metals and the like described in Japanese Patent Application Laid-Open (JP-A) No. 63-25208.

As the organic base, there can be listed as examples the following: ammonia, aliphatic or aromatic amines, (for example, primary amines, secondary amines, tertiary amines, polyamines, hydroxylamines and heterocyclic amines), amidines; bis, tris or tetraamidines; guanidines; water-insoluble mono, bis, tris or tetraguanidines and quaternary ammonium hydroxides.

As the base precusor, there can be listed as examples the following: a decarboxylation type, a decomposition type, a reaction type and a complex salt formation type.

Examples of the base and the base precursor that can preferably be employed in the present invention are described in "Publicly Known Techniques," No. 5, pp. 55 to 88 (Mar. 22, 1991) published by Aztech Co. Ltd., Tokyo.

A base producing method that can most preferably be employed in the present invention is a method described in EP No. 210,660 and U.S. Pat. No. 4,740,445, in which a base is produced in a combination of a basic metal compound that is difficult to dissolve in water and a compound that can perform a complex forming reaction with a metal ion forming this basic metal compound, with water as a medium. In this case, the basic compound that is difficult to dissolve in water is preferably added to the photosensitive element and the complex forming compound is preferably added to the developing processing element, although the reverse is also possible. As preferable combinations of compounds, a system can be named wherein fine particles of zinc hydroxide are employed in the photosensitive element, while a salt of picolinic acid, guanidine picolinate, for example is employed in the developing processing element.

A mordant may be used in the developing processing element; if a mordant is used, a polymer mordant is preferable. In addition, as abinder, awater-soluble polymer such as gelatin, as has been described in the section of a photosensitive element is preferably employed.

The developing processing element may include auxiliary layers such as a protective layer, an undercoat layer, a back layer and others, in addition to a processing layer. Each of these layers are necessarily hardened with a hardener. Hardeners used for hardening of the layers are the same as those for the photosensitive element.

The developing processing element in the present invention may be either in the form of a sheet or a continuous web. As in the case of the processing element of the present invention, it is preferable that the processing layer is provided on the substrate in the form of a continuous web and that the substrate is rolled out from a feed roll, not cut after being used and then rolled again around a take-up roll. An example of this case is described in Japanese Patent Application Laid-Open (JP-A) No. 9-127670.

The substrate for the developing processing element and the thickness thereof can be selected from the same category or range as those for the processing element of the present invention.

Below in an example, a practical aspect of forming an image according to the present invention will be described. First, the photosensitive element is processed for use in an ordinary 135 camera, an APS camera or a film with a lens, and then packed in a cartridge. The photosensitive element on which a photograph has been taken with a camera is rolled out from the cartridge and developed, using the developing processing element, by heating the photosensitive layer and the developing processing layer, which have been superposed on each other in the presence of a small amount of water therebetween. At this point, if the amount of water is too small, developing does not progress sufficiently, whereas if the amount of water is too large, there may arise inconveniences wherein not only does water flood from the film surface but it takes a long time to dry the photosensitive element after separation. Water is preferably used in an amount corresponding to a value in a range of from 0.1 to 1 times the amount required for swelling all of the coated films, except for the respective back layers of the photosensitive element and the developing processing element, to the swelling maximums thereof, in a more concrete manner preferably in a range of from 1 cc/m$^2$ to 50 cc/m$^2$. With the presence of water in this amount, the photosensitive layer and the developing processing layer are superposed on each other while they are opposed to each other and then heated at a temperature in a range of from 60° C. to 100° C., for 5 to 60 seconds.

As method for adding the water, a method is proposed in which the photosensitive element or the processing element is immersed in water and then excessive water on the elements is removed with a squeeze roller. Another method, described in Japanese Patent Application Laid-Open (JP-A) No. 8-123001, is also preferred. In this method, water is jetted onto the photosensitive element and the processing element from a water-applying device, which comprises: a plurality of nozzles for jetting water, arranged in a straight line at constant intervals along a direction that intersects with a direction along which the photosensitive element or the processing element is transported; and an actuator, which displaces the nozzles towards, the photosensitive element or the processing element on a transport route. Another method in which water is applied with a sponge or the like is also preferable.

As a heating method, contact with a heated block or plate, a heat roller, a heat drum, an infrared lamp, a far-infrared lamp and the like may be employed.

After developing processing, the photosensitive element is separated from the developing processing element and the processing element of the present invention (hereinafter referred to as a silver halide dissolving processing element) is used to perform a silver halide dissolving treatment. This treatment is preferably conducted in such a manner that the photosensitive element and the silver halide dissolving processing element are superposed on each other in the presence of water between the photosensitive layer and the treatment layer, and then heated, wherein it is preferable that the amount of water is in a range of from 1 cc/m$^2$to 50 cc/m$^2$and that heating is conducted at a temperature in a range of from 40° C. to 100° C. for a period of time in a range of from 2 to 60 seconds.

A method for supplying the water may be to supply the photosensitive element with water again after developing processing, or to superpose the silver halide dissolving processing element on which water has been supplied in advance. However, a method wherein the photosensitive element after the developing processing is separated from the developing processing element and the silver halide dissolving processing element can be superposed without drying is preferred, in order to simplify the steps.

After the dissolving process of silver halide, the photosensitive element is separated from the silver halide dissolving processing element and dried, and thereby a stabilized image can be obtained on the photosensitive element. At this point, it is possible to wash the photosensitive element with water before drying.

In a preferred embodiment of the present invention, after obtaining an image on the photosensitive element, a color image is formed on a different recording element based on the information of the image formed on the photosensitive element. As methods thereof, while a method, in which a photosensitive material such as a color paper is employed and the paper is subjected to an ordinary projection exposure may be considered, another method is preferable, in which image information is photoelectrically read by measurement of the density of transmitted light and converted into digital signals, and after image processing, image information is sent to a different recording material such as a thermal development photosensitive material, using the output signals. In addition to the photosensitive element using silver halide, material upon which the information is output may be a sublimation type thermosensitive record material, a full-color direct thermosensitive record material, an ink jet material, an electrophotographic material or the like.

A used photosensitive element can be stored by being packed in the same cartridge or a different cartridge.

EXAMPLES

Below, effects of the present invention will be detailed through examples.

Example 1

Preparing Method for a Photosensitive Silver Halide Emulsion A preparing method for a blue photosensitive silver halide emulsion (1) will be described below.

Distilled water (1191 ml) including gelatin (0.96 g) with an average molecular weight of 12,000 and potassiumbromide (0.9 g) was put in a reaction vessel and the solution was heated to 40° C. 10.5 ml of an aqueous solution (A) including 0.5 g of silver nitrate and 10 ml of an aqueous solution (B) including 0.35 g of potassium bromide were added to the solution over 150 seconds while stirring the solution vigorously. A 10% potassium bromide aqueous solution (12 ml) was added to the solution 30 seconds after completion of the addition and 30 seconds thereafter, the reaction solution was heated to 75° C. Lime-treated gelatin (35.0 g) and distilled water (250 ml) were added to the solution and thereafter, 39 ml of an aqueous solution (C) including 10 g of silver nitrate and 30 ml of an aqueous solution (D) including 6. 7 g of potassium bromide were added to the solution over a 3 minute, 15 second period while the addition rate was raised. Then, 302 ml of an aqueous solution (E) including 96.7 g of silver nitrate and a 26% concentration potassium bromide aqueous solution (F) including potassium and potassium bromide in a mole ratio of 7:93 were added to the reaction solution over 20 minutes while the addition rate was accelerated so that the silver potential in the reaction solution relative to the saturated calomel electrode become −20 mV. Further, 97 ml of an aqueous solution (G) including 24.1 g of silver nitrate and an aqueous solution (H) (21.9% potassium bromide) were added to the reaction solution over a 3 minute period so that the silver potential in the reaction solution, with respect to the saturated calomel electrode, became 25 mV. The reaction solution was kept at 75° C. for 1 minute after completion of the addition and thereafter, the reaction solution was cooled to 55° C. Next, a 1 N sodium hydroxide solution (15 ml) was added to the reaction solution. Thereafter, after 2 minutes elapsed, 100 ml of an aqueous solution (I) including 5 g of silver nitrate and 200.5 ml of an aqueous solution (J) including 4.7 g of potassium iodide were added to the reaction solution over a 5 minute period. After completion of the addition, potassium bromide (7.11 g) was added to the reaction solution, the reaction solution was kept at 55° C. for 1 minute, and then 248 ml of an aqueous solution (K) including 62 g of silver nitrate and 231 ml of an aqueous solution (L) including 48.1 g of potassium bromide were added to the reaction solution over an 8 minute period. After 30 seconds elapsed from completion of the addition, an aqueous solution including 0.03 g of sodium ethythiosulfonate was added to the reaction solution. Thereafter, the temperature of the reaction solution was lowered and dispersed particles in the emulsion were subjected to coagulating sedimentation using Demol made by Kao K. K. Thereby, desalting was performed. Dispersion was performed by adding sodium benzenethiosulfonate, phenoxyethanol, water-soluble polymer (10) and lime-treated gelatin to the reaction solution.

Chemical sensitization was conducted at 60° C. A sensitizing dye (12) was added to the reaction solution as a dispersed phase in gelatin before the chemical sensitization; thereafter, a mixture solution of potassium thiocyanate and gold chloride were added to the reaction solution. Next sodium thiosulfate and a selenium sensitizer were added to the reaction solution, and stoppage of the chemical sensitization was performed with a mercapto compound. Amounts of a sensitizing dye, a chemical sensitizer and the mercapto compound were optimized with regard to sensitivity and the degree of fogging.

Tabular grains among obtained grains accounted for more than 99% of the entire projected area of the grain population, the mean effective spherical diameter was 1.07 μm, the mean thickness was 0.38 μm, the effective circular diameter was 1.47 μm and the aspect ratio was 3.9:1.

Water-soluble polymer (10)

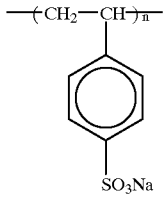

Sensitizing dye (12)

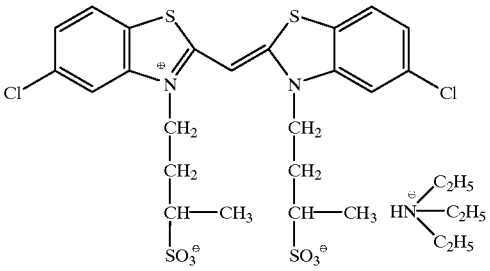

Selenium sensitizer

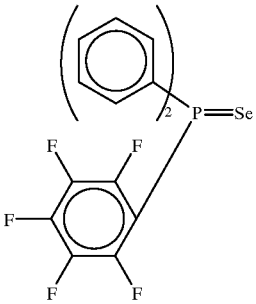

Mercapto compound

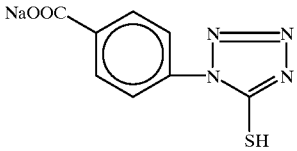

A preparing method for a blue photosensitive silver halide emulsion (2) will be described below.

Distilledwater (1191 ml) including gelatin (0.96 g) with an average molecular weight of 12,000 and potassium bromide (0.9 g) was put in a reaction vessel and the solution is heated to 40° C. 37.5 ml of an aqueous solution (A) including 1.5 g of silver nitrate and 37.5 ml of an aqueous solution (B) including 1.051 g of potassium bromide were added to the solution over a 90 second period while stirring the solution vigorously. A 10% potassium bromide aqueous solution (12 ml) was added to the solution 30 seconds after completion of the addition and 30 seconds thereafter, the reaction solution was heated to 75° C. Lime-treated gelatin (35.0 g) and distilled water (250 ml) were added to the reaction solution and thereafter, 116 ml of an aqueous solution (C) including 29.0 g of silver nitrate and 91 ml of an aqueous solution (D) including 20 g of potassium bromide were added to the reaction solution over an 11 minute, 35 second period while the addition rate was accelerated. Then, 302 ml of an aqueous solution (E) including 96.7 g of silver nitrate and a 26% concentration potassium bromide aqueous solution (F) including potassium iodide and potassium bromide in a mole ratio of 3.3 96.7 were added to the reaction solution over a 20 minute period while the addition rate was accelerated so that the silver potential in the reaction solution relative to the saturated calomel electrode became 2 mV. Further, 97 ml of an aqueous solution (G) including 24.1 g of silver nitrate and the aqueous solution (H) 21.9% potassium bromide were added to the reaction solution over a 3 minute period so that the silver potential in the reaction solution relative to the saturated calomel electrode became 0 mV. The reaction solution was kept at 75° C. for 1 minute after completion of the addition and thereafter, the reaction solution was cooled to 55° C. Then, a 1 N sodium hydroxide solution (15 ml) was added to the reaction solution. Thereafter, after 2 minutes elapsed, 153 ml of an aqueous solution (I) including 10.4 g of silver nitrate and 414.5 ml of an aqueous solution (J) including 9.35 g of potassium iodide were added to the reaction solution over a 5 minute period. After completion of the addition, potassium bromide (7.11 g) was added to the reaction solution and the reaction solution was kept at 55° C. for 1 minute, and then 228 ml of an aqueous solution (K) including 57.1 g of silver nitrate and 201 ml of an aqueous solution (L) including 43.9 g of potassium bromide were added to the reaction solution over an 8 minute period. After 30 seconds elapsed from completion of the addition, an aqueous solution including 0.04 g of sodium ethythiosulfonate was added to the reaction solution. Thereafter, the temperature of the reaction solution was lowered, and desalting and dispersion was performed as in the case of a blue photosensitive silver halide emulsion (1). Chemical sensitization was performed as in the case of a blue-sensitive silver halide emulsion (1) with the exception that the selenium sensitizer was not added. A sensitizing dye and a mercapto compound for stopping the chemical sensitization were both added in amounts almost proportional to the total surface area of emulsion grains.

Tabular grains among obtained grains accounted for 99% of the entire projected area of the grain population, the mean effective spherical diameter was 0.66 μm, the mean thickness was 0.17 μm, the effective circular diameter was 1.05 μm and the aspect ratio was 6.3:1.

A preparing method for a blue photosensitive silver halide emulsion (3) will be described below.

Distilled water (1345 ml) including lime-treated gelatin (17.8 g), potassium bromide (6.2 g) and potassium iodide (0.46 g) was put in a reaction vessel and the solution was heated to 45° C. 70 ml of an aqueous solution (A) including 11.8 g of silver nitrate and 70 ml of an aqueous solution (B) including 3.8 g of potassium bromide were added to the solution over 45 seconds while stirring the solution vigorously. After the reaction solution was kept at 45° C. for 4 minutes, the temperature of the reaction solution was raised to 63° C. Lime-treated gelatin (24.0 g) and distilled water (185 ml) were added to the reaction solution and thereafter, 208 ml of an aqueous solution (C) including 73 g of silver nitrate and a 24.8% potassium bromide aqueous solution (D) were added to the reaction solution over a 13 minute period while the addition rate was accelerated so that the silver potential in the reaction solution relative to the saturated calomel electrode became 0 mV. The reaction solution was kept at 63° C. for 2 minutes following completion of the addition, and then the temperature of the reaction solution was lowered to 45° C. Then, a 1 N sodium hydroxide (15 ml) was added to the reaction solution. Thereafter, after 2 minutes elapsed, 60 ml of an aqueous solution (E) including 8.4 g of silver nitrate and 461 ml of an aqueous solution (F) including 8.3 g of potassium iodide were added to the reaction solution over the following 5 minute period. Further, 496 ml of an aqueous solution (G) including 148.8 g of silver nitrate and an aqueous solution (H) 25% potassium bromide were added to the reaction solution over a 47 minute period so that the silver potential in the reaction solution relative to the saturated calomel electrode became 90 mV. After 30 seconds elapsed from completion of the addition, an aqueous solution including 2 g of potassium bromide and 0.06 g of sodium ethythiosulfonate were added to the reaction solution. Thereafter, the temperature of the reaction solution was lowered, and desalting and dispersion, and chemical sensitization were performed as in the case of a blue photosensitive silver halide emulsion (2). Obtained emulsion grains were hexagonal tabular grains with a mean effective spherical diameter of 0.44 μm, a mean thickness of 0.2 μm, an effective circular diameter of 0.53 μm and an aspect ratio of 2.6:1.

A preparing method for a green photosensitive silver halide emulsion (4) will be described below.

Distilled water (1191 ml) including gelatin (0.96 g) with an average molecular weight of 12,000 and potassiumbromide (0.9 g) was put in a reaction vessel and the solution was heated to 40° C. 17.5 ml of an aqueous solution (A) including 0.7 g of silver nitrate and 17.5 ml of an aqueous solution (B) including 1.051 g of potassium bromide were added to the solution over 120 seconds while stirring the solution vigorously. A 10% potassium bromide aqueous solution (12 ml) was added to the solution 30 seconds after completion of the addition and 30 seconds thereafter, the reaction solution was heated to 75° C. Lime-treated gelatin (35.0 g) and distilled water (250 ml) were added to the reaction solution and thereafter, 56 ml of an aqueous solution (C) including 19.0 g of silver nitrate and 461 ml of an aqueous solution (D) including 10 g of potassium bromide were added to the reaction solution over a 7 minute, 35 second period while the addition rate was accelerated. Then, 302 ml of an aqueous solution (E) including 96.7 g of silver nitrate and a 26% concentration potassium bromide aqueous solution (F) including potassium iodide and potassium bromide in a mole ratio of 3.3:96.7 were added to the reaction solution over a 20 minute period while the addition rate was accelerated so that the silver potential in the reaction solution relative to the saturated calomel electrode became 0 mV. Further, 97 ml of an aqueous solution(G) including 24.1 g of silver nitrate and an aqueous solution (H) 21.9% potassium bromide were added to the reaction solution over a 3 minute period so that the silver potential in the reaction solution relative to the saturated calomel electrode became 0 mV. The reaction solution was kept at 75° C. for 1 minute after completion of the addition and thereafter, the reaction solution was cooled to 55° C. 122 ml of an aqueous solution (I) including 8.3 g of silver nitrate and 332 ml of an aqueous solution (J) including 7.48 g of potassium iodide were added to the reaction solution over a 5 minute period. After completion of the addition, potassium bromide (7.11 g) was added to the reaction solution and the reaction solution was kept at 55° C. for 1 minute, and then 228 ml of an aqueous solution (K) including 62.8 g of silver nitrate and 201 ml of an aqueous solution (L) including 48.3 g of potassium bromide were added to the reaction solution over an 8 minute period. The temperature of the reaction solution was lowered, and desalting and dispersion was performed as in the case of a blue photosensitive silver halide emulsion (1). Chemical sensitization was also performed as in the case of a blue photosensitive silver halide emulsion (1), with the exception that gelatin in which a mixture of sensitizing dyes (13), (14) and (15) in a mole ratio of 12:2:1 was dispersed was used instead of the sensitizing dye (12).

Tabular grains among obtained grains accounted for more than 99% of the entire projected area of the grain population, the mean effective spherical diameter was 0.85 μm, the mean thickness was 0.26 μm, the effective circular diameter was 1.25 μm and the aspect ratio was 4.8:1.

Green photosensitive emulsion sensitizing dye (13)

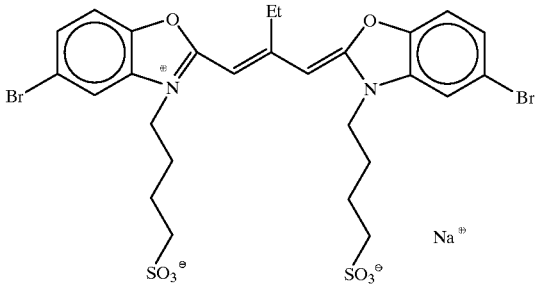

Green photosensitive emulsion sensitizing dye (14)

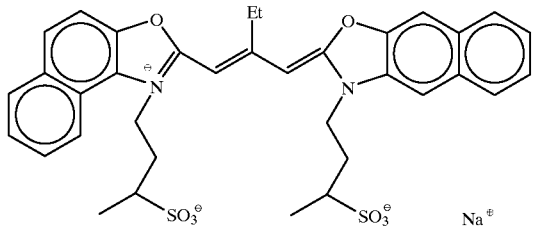

Green photosensitive emulsion sensitizing dye (15)

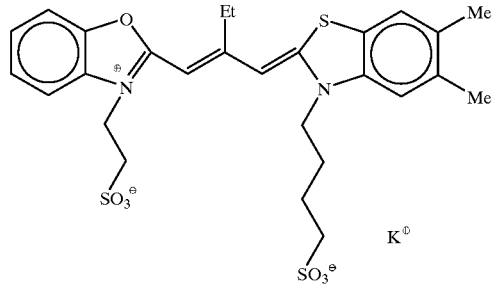

A preparing method for a green photosensitive silver halide emulsion (5) will be described below.

Desalting and dispersion were performed as in the case of the blue photosensitive silver halide emulsions with the exception that sodium hydroxide and sodium ethythiosulfonate were not added during grain formation. Chemical sensitization was performed as in the case of the green photosensitive silver halide emulsion (4).

Tabular grains among obtained grains accounted for more than 99% of the entire projected area of the grain population, the mean effective spherical diameter was 0.66 μm, the mean thickness 0.17 μm, the effective circular diameter was 1.05 μm and the aspect ratio was 6.3:1.

A preparing method for a green photosensitive silver halide emulsion (6) will be described below.

Grain formation, desalting and dispersion were performed as in the case of the blue photosensitive silver halide emulsion (3) with the exception that sodium hydroxide was not added during grain formation and the amount of sodium ethythiosulfonate was changed to 4 mg. Chemical sensitization was performed as in the case of the green-sensitive silver halide emulsion (4) with the exception that a selenium sensitizer was not added.

Obtained emulsion grains were hexagonal tabular grains with a mean effective spherical diameter of 0.44 μm, a mean thickness of 0.2 μm, an effective circular diameter of 0.53 μm and a mean aspect ratio of 2.6:1.

A preparing method for a red-sensitive silver halide emulsion (7) will be described below.

The emulsion was prepared as in the case of the green-sensitive silver halide emulsion (4) with the exception that in the chemical sensitization, sensitizing dyes, i.e., a sensitizing dye (16) and a mixture of the sensitizing dyes (17) and (18), were added in dispersed phases in gelatin, wherein the mole ratio of the dyes (16), (17) and (18) was 40:2:58. Tabular grains among obtained grains accounted for more than 99% of the entire projected area of the grain population, the mean effective spherical diameter was 0.85 μm, the mean thickness was 0.26 μm, the effective circular diameter was 1.25 μm and the aspect ratio was 4.8:1.

Red-sensitive emulsion sensitizing dye (16)

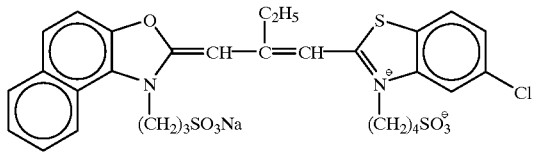

Red-sensitive emulsion sensitizing dye (17)

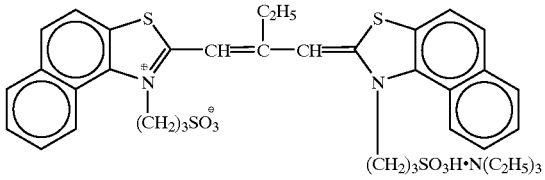

Red-sensitive emulsion sensitizing dye (18)

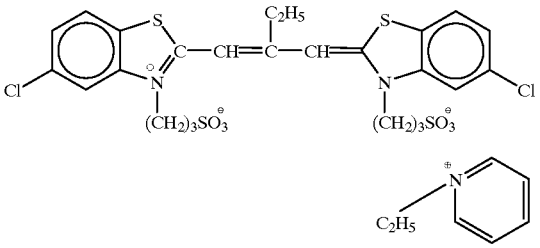

A preparing method for a red-sensitive silver halide emulsion (8) will be described below.

The emulsion was prepared as in the case of the green-sensitive silver halide emulsion (5) with the exception that in the chemical sensitization, sensitizing dyes, i.e., the sensitizing dye (16) and a mixture of the sensitizing dyes (17) and (18), were added in dispersed phases in gelatin, wherein the mole ratio of the dyes (16), (17) and (18) was 40:2:58. Tabular grains among obtained grains accounted for more than 99% of the entire projected area of the grain population, the mean effective spherical diameter was 0.66 μm, the mean thickness was 0.17 μm, the effective circular diameter was 1.05 μm and the aspect ratio was 6.3:1.

A preparing method for a red-sensitive silver halide emulsion (9) will be described below.

The emulsion was prepared as in the case of the green-sensitive silver halide emulsion (6) with the exception that sensitizing dyes, i.e., the sensitizing dye (16) and a mixture of the sensitizing dyes (17) and (18), were added in dispersed phases in gelatin, wherein the mole ratio of the dyes (16), (17) and (18) was 40:2:58.

Obtained emulsion grains were hexagonal tabular grains with a mean effective spherical diameter of 0.44 μm, a mean thickness of 0.2 μm, an effective circular diameter of 0.53 μm and an aspect ratio of 2.6:1. A preparing method for zinc hydroxide in a dispersed phase for a fifth layer and a twelfth layer A powder of zinc hydroxide (31 g) with a primary particle size of 0.2 μm, carboxymethylcellulose as a dispersant (1.6 g), sodium polyacrylate (0.4 g), lime-treated ossein gelatin (8.5 g) and water (158.5 ml) were mixed and this mixture was dispersed in a mill using glass beads for 1 hour. After the dispersion, the glass beads were separated by filtration to obtain 188 g of zinc hydroxide in a dispersed phase.

A preparing method for a color developing agent and a coupler in a dispersed emulsion Components in an oil phase and components in a water phase, having compositions shown in Table 1, were dissolved to form oil and water phases as homogeneous solutions whose temperatures are 60° C., respectively. The solutions of the oil phase ingredients and the water phase ingredients were combined in a 1 liter stainless steel vessel and dispersed over a 20 minute period by a dissolver with a disperser, which was 5 cm in diameter, at a revolution speed of 10,000 rpm. Thereafter, as later-added water, warm water of an amount shown in Table 1 was added and the solution was mixed for 10 minutes at a revolution speed of 2,000 rpm. In this manner, a dispersed emulsion of a coupler, in each of cyan, magenta and yellow colors, were prepared.

TABLE 1

| | Cyan | Magenta | Yellow |
|---|---|---|---|
| Oil phase | | | |
| Cyan dye forming coupler C-1 | 3.58 g | — | — |
| Magenta dye forming coupler M-1 | — | 2.63 g | — |
| Yellow dye forming coupler Y-1 | — | — | 3.01 g |
| Developing agent D-9 | 1.49 g | 2.25 g | — |
| Developing agent D-14 | 0.73 g | — | — |
| Developing agent D-51B | — | — | 2.42 g |
| Tricresyl phosphate | 2.75 g | 2.5 g | 3.83 g |
| Ethyl acetate | 6 ml | 6 ml | 6 ml |
| Cyclohexanone | 6 ml | 6 ml | 6 ml |
| Water phase | | | |
| Lime-processed gelatin | 4 g | 4 g | 4 g |
| Sodium dodecylbenzenesulfonate | 0.27 g | 0.27 g | 0.27 g |
| Water | 53 ml | 53 ml | 53 ml |
| Later-added water | 28 ml | 30 ml | 29 ml |

TABLE 1-continued

Cyan coupler C-1

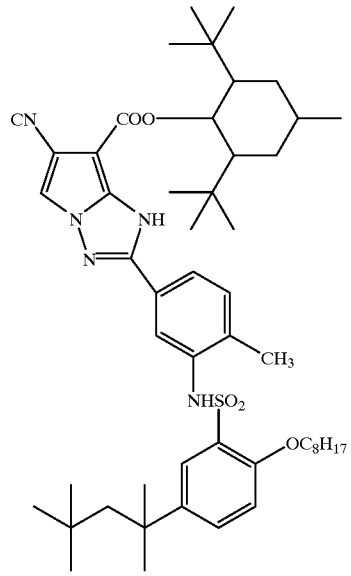

Magenta coupler M-1

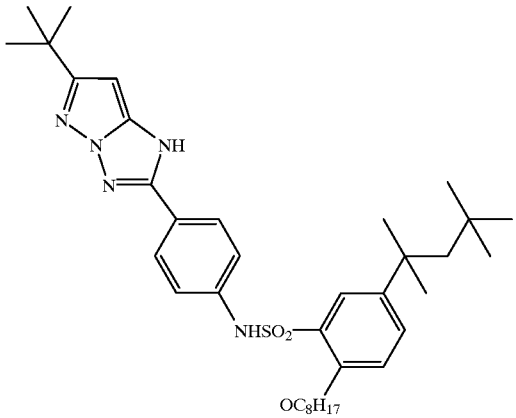

Yellow coupler Y-1

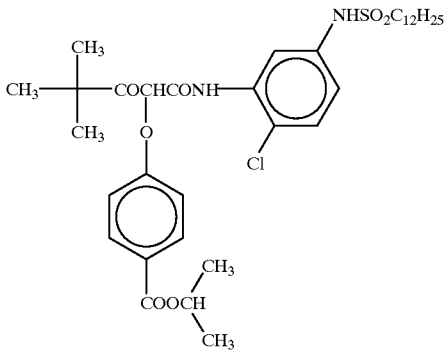

Preparation of dye compositions for a yellow filter layer, a magenta filter layer and an anti-halation layer Dye compositions were prepared and added as dispersed emulsions as described below.

Yellow dye (YF-1) (7.1 g) was dissolved in a mixture of tricresyl phosphate (6.6 g), ethyl acetate (30 cc) and cyclohexanone (30 cc) and the mixture was then poured in a 7.8% gelatin aqueous solution (135 g) including dodecylbenzenesulfonate (0.75 g). The mixture was stirred by a dissolver stirrer at a revolution speed of 10,000 rpm for 20 minutes, to form a dispersed emulsion. After dispersion, distilled water was added so that the mixture weighed 260 g in total and then the mixture was mixed for 10 minutes at a revolution speed of 2,000 rpm, whereby a dye dispersed emulsion for the yellow filter layer was prepared.

A dye dispersed emulsion for the magenta filter layer was prepared as in the case of the dye dispersed emulsion for the yellow filter layer with the exception that a magenta dye (MF-1) (6.1 g) was used instead of the yellow dye and the above described zinc hydroxide in a disperse phase was added.

A dye dispersed emulsion for the anti-halation layer was prepared as in the case of the dye dispersed emulsion for the yellow filter layer with the exception that a cyan dye (CF-1) (8.9 g) was used instead of the yellow dye.

YF-1

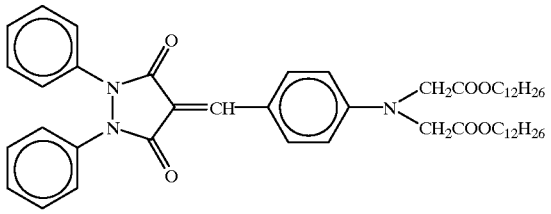

MF-1

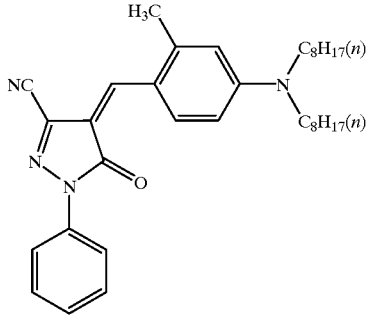

CF-1

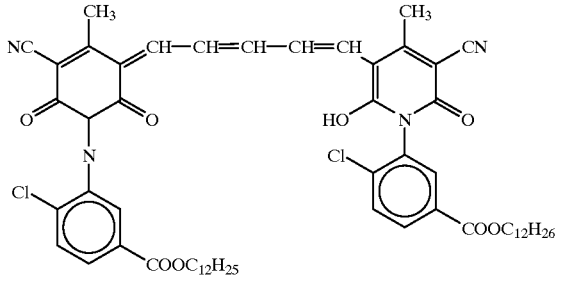

Preparation of a Substrate

The substrate which is to be used in the present invention was prepared by means of a method described below.

Polyethylene-2-,6-naphthalate (PEN) polymer (100 parts by weight) and Tinuvin P.326 (CIBA Geigy AG) (2 parts by weight) as an ultraviolet absorbent were dried, and then melted at 300° C., extruded through a T type die , stretched lengthwise at 140° C. to 3.3 times elongation and subsequently stretched crosswise at 130° C. to 3.3 times elongation. The result underwent heat setting at 250° C. for 6 seconds to obtain a PEN film with a thickness of 92 μm. To the PEN film thus produced, the following was added: a blue dye, a magenta dye and a yellow dye (*Journal of Technical Disclosure*, No. 94-6023-1, -4, -6, -24, -26, -27 and -5) at a yellow density of 0.01, a magenta density of 0.08 and a cyan density of 0.09. Then, the PEN film was rolled round a stainless steel reel core with a diameter of 20 cm and given a thermal history at 113° C. for 30 hours so that the film was completed as the substrate, which rarely curled.

Then, an undercoat layer and a back layer were provided on the PEN film. Here, [g/m$^2$], which is attached to each component and which follows a figure in parentheses, indicates the weight of the component per unit area of a coated layer. Application of an undercoat layer The substrate was subjected to a corona discharge treatment, a UV irradiation treatment and further a glow discharge treatment. Thereafter, an undercoat solution (10 cc/m$^2$), composed of gelatin (0.1 g/m$^2$), sodium α-sulfodi-2-ethylhexylsuccinate (0.01 g/m$^2$), salicylic acid (0.025 g/m$^2$) and PQ-1 (0.005 g/m$^2$) and PQ-2 (0.006 g/m$^2$), which are both expressed by structural formulae shown below, was applied by a bar coater to form the undercoat layer on a high temperature side of the PEN film during enlongation. The undercoat layer was dried at 115° C. for 6 minutes such that the temperatures of a roller in a drying zone and of a transport system were all kept at 115° C.

Application of a Back Layer

1) Application of an antistatic layer

The following were applied: a dispersed phase material with a resistivity of 5 Ω·cm made from a compound powder of tin oxide and antimony oxide with an average particle diameter of 0.005 μm, wherein the dispersed phase material had a secondary agglomerated particle diameter of about 0.08 μm; 0.027 g/m$^2$) gelatin (0.03 g/m$^2$), $(CH_2{=}CHSO_2CH_2CH_2NHCO)_2CH_2$ (0.02 g/m$^2$) poly (polymerization degree of 10)oxyethylene-P-nonylphenol (0.005 g/m$^2$), PQ-3 (0.008 g/m$^2$) and resorcin.

2) Application of a magnetic recording layer

The following were applied on the substrate using a bar coater to obtain a magnetic recording layer with a film thickness 1.2 μm: cobalt-γ-iron oxide (specific surface area 43m$^2$/g, major axis 0.14 μm, minor axis 0.03 μm, saturation magnetization 89 emu/g, $Fe^{+2}/Fe^{+3}$=6/94, a surface thereof treated by aluminum oxide and silicon oxide, with these oxides in an amount that is 2% by weight of the iron oxide) at 0.06 g/m$^2$, subjected to coating processing with 3-poly (polymerization degree of 15)oxyethylene-propyloxytrimethoxysilane (15% by weight); diacetylcellulose as a dispersant (iron oxide was dispersed using an open kneader and a sandmill) at 1.15 g/m$^2$; as hardeners, PQ-4 and PQ-5 represented by the following structural formulae, at 0.075 g/m$^2$ and 0.004 g/m$^2$, respectively; $C_6H_{13}CH(OH)C_{10}H_{20}COOC_{40}H_{81}$ as a lubricant at 50 g/m$^2$; silica particles as a matting agent (an average particle diameter of 1.0 μm) at 5 mg/M$^2$; aluminum oxide as a polishing agent (ERC-DBM made by Reynolds Metal Co., with an average particle diameter of 0.44 μm) at 15 mg/m$^2$; and acetone, methylethylketone, cyclohexanone or dibuthylphthalate as a solvent. The magnetic recording layer was dried at 115° C. for 6 minutes, such that the temperatures of a roller in a drying zone and a transport system were all kept at 115° C. The increment in color density of $D^B$ of a magnetic recording layer under an X-light (with a blue filter) is about 0.1, the magnetizing moment in saturation was 4.2 emu/g, the coercive force was $7.3\times10^4$ A/m and the rectangularity ratio was 65%.

3) Adjustment of a lubricant layer

Hydroxyethylcellulose (25 mg/m$^2$), PQ-6 (7.5 mg/M$^2$), PQ-7 (1.5 mg/M$^2$) and polydimethylsiloxane (1.5 mg/M2) were applied. The coating solution was prepared by the procedures: the above-described components were melted in a mixture of xylene/prolyleneglycolmonomethylether (1:1) at 105° C. and poured into propylenemonomethylether (10 times the volume of the mixture) at ordinary temperature so as to be dispersed, and thereafter further dispersed in acetone, wherein dispersed particles had an average diameter of 0.01 μm. The coat was dried at 115° C. for 6 minutes, such that the temperatures of a roller in a drying zone and a transport system were all kept at 115° C. The lubricant layer had excellent characteristics such as the following: a coefficient of dynamic friction of 0.10 (under conditions of a load of 100 g and a speed of 6 cm/min with a stainless steel ball having a diameter of 5 mm); a coefficient of static friction of 0.09 (as a result of a clip method); and furthermore, a coefficient of dynamic friction between the above described emulsion surface and the lubricant layer of 0.18.

PQ-1

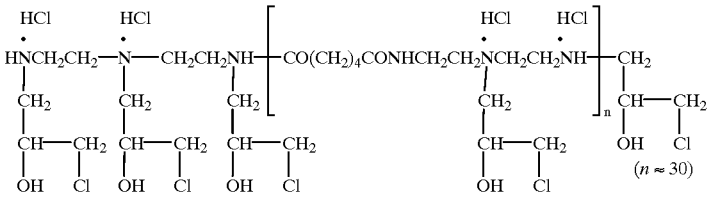

PQ-2

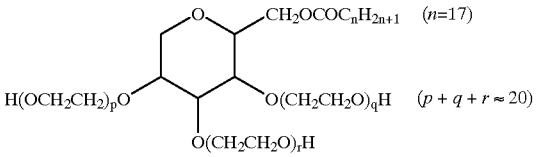

PQ-3

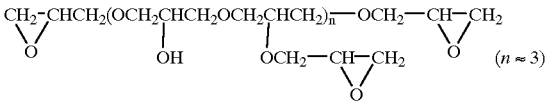

PQ-4

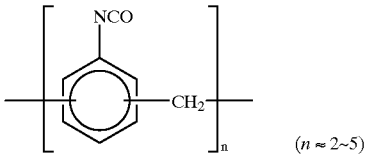

PQ-5

$(CH_3O)_3SiCH_2CH_2CH_2O(CH_2CH_2O)_nCH_3$ ($n \approx 7.3$)

PQ-6

$C_{50}H_{101}(CH_2CH_2O)_nH$ ($n \approx 16$)

PQ-7

$C_8F_{17}SO_2N(C_3H_7)(CH_2CH_2O)_n(CH_2)_4SO_3Na$ ($n \approx 4$)

A photosensitive element 101 having a multilayer structure shown in Tables 2 and 3 using the materials and base described above was prepared.

TABLE 2

Photosensitive element 101

| Layer structure | Major materials | Application amount (g/m$^2$) |
|---|---|---|
| 13th layer | Gelatin | 0.89 |
| Protective layer | Matting agent (silica) | 0.02 |
| 12th layer | Gelatin | 0.76 |
| Intermediate layer | Zinc hydroxide | 0.34 |
| 11th layer | Gelatin | 0.86 |
| Yellow color forming layer | Silver halide emulsion (1) | 0.50 (as the weight of silver metal) |
| (high sensitivity layer) | Yellow coupler (Y-1) | 0.29 |
| | Developing agent (D-51B) | 0.23 |
| | Tricresyl phosphate | 0.36 |
| 10th layer | Gelatin | 1.44 |
| Yellow color forming layer | Silver halide emulsion (2) | 0.25 (as the weight of silver metal) |
| (low sensitivity layer) | Silver halide emulsion (3) | 0.25 (as the weight of silver metal) |

TABLE 2-continued

| Photosensitive element 101 | | |
|---|---|---|
| Layer structure | Major materials | Application amount (g/m$^2$) |
| | Yellow coupler (Y-1) | 0.45 |
| | Developing agent (D-51B) | 0.36 |
| | Tricresyl phosphate | 0.56 |
| 9th layer | Gelatin | 0.21 |
| Intermediate layer | Yellow dye YF-1 | 0.14 |
| Yellow filter layer | Tricresyl phosphate | 0.13 |
| 8th layer | Gelatin | 0.43 |
| Magenta color forming layer | Silver halide emulsion (4) | 0.55 (as the weight of silver metal) |
| (high sensitivity layer) | Magenta coupler (M-1) | 0.04 |
| | Developing agent (D-9) | 0.03 |
| | Tricresyl phosphate | 0.04 |
| 7th layer | Gelatin | 0.5 |
| Magenta color forming layer | Silver halide emulsion (5) | 0.35 (as the weight of silver metal) |
| (medium sensitivity layer) | Magenta coupler (M-1) | 0.07 |
| | Developing agent (D-9) | 0.06 |
| | Tricresyl phosphate | 0.07 |
| 6th layer | Gelatin | 0.52 |
| Magenta color forming layer | Silver halide emulsion (6) | 0.34 (as the weight of silver metal) |
| (low sensitivity layer) | Magenta coupler (M-1) | 0.19 |
| | Developing agent (D-9) | 0.16 |
| | Tricresyl phosphate | 0.18 |

TABLE 3

| | | |
|---|---|---|
| 5th layer | Gelatin | 1.15 |
| Intermediate layer | Magenta dye MF-1 | 0.1 |
| Magenta filter layer | Zinc hydroxide | 2.03 |
| | Tricresyl phosphate | 0.1 |
| 4th layer | Gelatin | 0.96 |
| Cyan color forming layer | Silver halide emulsion (7) | 1.05 (as the weight of silver metal) |
| (high sensitivity layer) | Cyan coupler (C-1) | 0.07 |
| | Developing agent (D-9) | 0.03 |
| | Developing agent (D-14) | 0.014 |
| | Tricresyl phosphate | 0.05 |
| 3rd layer | Gelatin | 0.24 |
| Cyan color forming layer | Silver halide emulsion (8) | 0.27 (as the weight of silver metal) |
| (medium sensitivity layer) | Cyan coupler (C-1) | 0.054 |
| | Developing agent (D-9) | 0.022 |
| | Developing agent (D-14) | 0.011 |
| | Tricresyl phosphate | 0.04 |
| 2nd layer | Gelatin | 0.73 |
| Cyan color forming layer | Silver halide emulsion (9) | 0.55 (as the weight of silver metal) |
| (low sensitivity layer) | Cyan coupler (C-1) | 0.32 |
| | Developing agent (D-9) | 0.13 |
| | Developing agent (D-14) | 0.065 |
| | Tricresyl phosphate | 0.25 |
| 1st layer | Gelatin | 0.24 |
| Antihalation layer | Cyan dye CF-1 | 0.2 |
| | Tricresyl phosphate | 0.15 |
| | Undercoat layer | |
| | PEN base having a thickness of 92 μm | |
| | Undercoat layer | |
| | Antistatic layer | |
| | Magnetic recording layer | |
| | Lubricant layer | |

Note: the coated layers on the photosensitive layer side each are hardened by application of a hardener (H-1) at 0.1 g/m$^2$.

H-1

$$CH_2{=}CH{-}SO_2{-}CH_2{-}SO_2{-}CH{=}CH_2$$

In addition, a developing processing element R-1 with the contents shown in Table 4 and a silver halide dissolving processing element with the contents shown in Table 5 were prepared.

TABLE 4

| First processing element R-1 | | |
|---|---|---|
| Layer structure | Major materials | Application amount (g/m$^2$) |
| 4th layer | Gelatin | 0.22 |
| | κ-carrageenan | 0.06 |
| | Silicone oil | 0.02 |
| | Matting agent (PMMA) | 0.4 |
| 3rd layer | Gelatin | 0.24 |

TABLE 4-continued

First processing element R-1

| Layer structure | Major materials | Application amount (g/m$^2$) |
|---|---|---|
| | Hardener (H-2) | 0.18 |
| 2nd layer | Gelatin | 2.41 |
| | Dextran | 1.31 |
| | Mordant (P-1) | 2.44 |
| | Guanidine picolinate | 5.82 |
| | Potassium quinolinate | 0.45 |
| | Sodium quinolinate | 0.36 |
| 1st layer | Gelatin | 0.19 |
| | Hardener (H-2) | 0.18 |
| | Undercoat layer | |
| | PET base having a thickness of 63 $\mu$m | |

H-2

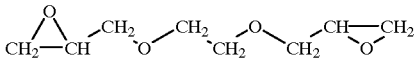

P-1

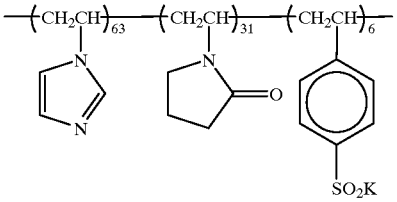

TABLE 5

Second processing element R-2

| Layer structure | Major materials | Application amount (g/m$^2$) |
|---|---|---|
| 4th layer | Gelatin | 0.49 |
| | Matting agent (silica) | 0.01 |
| 3rd layer | Gelatin | 0.24 |
| | Hardener (H-3) | 0.25 |
| 2nd layer | Gelatin | 4.89 |
| | Silver halide dissolving agent (F2) | 5.77 |
| 1st layer | Gelatin | 0.37 |
| | Hardener (H-3) | 0.58 |
| | Gelatin undercoat layer | |
| | PET base having a thickness of 63 $\mu$m | |

H-3

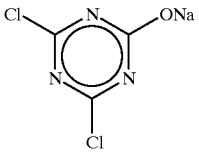

The prepared photosensitive element 101 was cut in an APS format, perforated and packed into a cartridge. Thereafter the photosensitive element 101 was loaded into an APS camera and photo shooting was conducted for taking a picture of a person and of a Macbeth chart.

Water at a temperature of 40° C. (15 cc/m$^2$, which corresponds to 45% of the water required for maximal swelling) was applied on the photosensitive element used in the shooting. There after, the photosensitive element was superposed on the developing processing element R-1, and the superposed composite was heated from the back side of the photosensitive element with a heat drum at 83° C. for 17 seconds. After heating, the developing processing element R-1 was separated from the photosensitive element 101, and water at a temperature of 40° C. was again applied on the photosensitive element at 15 cc/m$^2$. Subsequently, the photosensitive element was superposed on the silver halide dissolving processing element R-2 and the superposed composite was heated at 83° C. for 15 seconds. After heating, the silver halide dissolving processing element R-2 was separated from the photosensitive element 101 to obtain a negative image, which was excellent in transparency, on the photosensitive element. The image was read by a digital image reading device Frontier SP-1000 made by Fuji Photo Film Co. Ltd., and subjected to image processing at a work station. A good print image was obtained through being output from a thermally developing printer (PICTROGRAPHY 4000 made by Fuji Photo Film Co. Ltd.).

The photosensitive element 101 with the used negative image on it was rolled back again into the cartridge and this sample was left untouched at a temperature of 30° C. and at a relative humidity of 90% for one week. Then, the image was read again by SP-1000, subjected to image processing and a processing result was obtained in the form of a good print image after outputting was carried out. There was no deposition on a surface of the photosensitive element.

Comparative Example 1

A silver halide dissolving processing element R-3 was prepared as in the case of the silver halide dissolving processing element R-2 with the exception that the silver halide solvent in the R-2 was replaced with a molar equivalent weight of a mixture of silver halide solvents M-1 and M-2 (in a mole ratio of 4:1) which was used in Japanese Patent Application Laid-Open (JP-A) No. 9-258402.

M-1

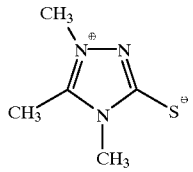

M-2

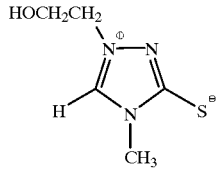

(compounds used in Japanese Patent Application Laid-Open (JP-A) No. 9-258402)

The photosensitive element 101, the developing processing element R-1 and the silver halide dissolving processing element R-3 were used and evaluation was conducted as in the case of example 1. A good print image was obtained. However, after the photosensitive element 101 with the used negative image on it was left untouched at a temperature of 30° C. and a relative humidity of 90% for one week, deposition occurred on a surface of the photosensitive element and a good print image could not be obtained from the negative image even after reading and processing with SP-1000.

Example 2

A silver halide dissolving processing element R-4 was prepared as in the case of the silver halide dissolving processing element R-2 with the exception that the silver halide solvent (F2) of the silver halide dissolving processing element R-2 was replaced with a molar equivalent weight of a mixture of the compounds (F3) and (F10) (in a mole ratio of 1:1).

A photosensitive element 102 was prepared as in the case of the photosensitive element 101 with the exception that tricresyl phosphate was replaced with trioctylamine represented by the general formula (9) in the recipe of the emulsion of Table 1.

The photosensitive element 102, the developing processing element R-1 and the silver halide dissolving processing element R-4 were used and evaluation was conducted as in the case of example 1. Since the photosensitive element was neutralized, better storage capability could be attained.

The photosensitive element 102 with the used negative image on it was rolled back again into the cartridge and this sample was left untouched at a temperature of 30° C. and a relative humidity of 90% for one week. Then, the image was again read by SP-1000, subjected to image processing and a processing result was obtained in the form of a good print image after outputting was carried out. There was no deposition on a surface of the photosensitive element.

Example 3

A silver halide dissolving processing element R-5 was prepared as in the case of the silver halide dissolving processing element R-4 with the exception that polyacrylic acid (20% was neutralized) was added in a second layer of the silver halide dissolving processing element R-4, at 2.3 g/m$^2$.

The photosensitive element 102 and the developing processing element R-1 and the silver halide dissolving processing element R-5 were used and evaluation was conducted as in the case of example 1. As a result, a good print image was likewise obtained.

Since the photosensitive element was neutralized, better storage capability of a negative image was obtained than in the case of example 1. The photosensitive element 102 with the used negative image on it was rolled back again into the cartridge and this sample was left untouched at a temperature of 60° C. and a relative humidity of 70% for one week. Then, the image was again read by SP-1000, subjected to image processing and after outputting was carried out, a processing result was obtained in the form of a good print image, of the same quality as the image formed directly after processing. There was no deposition on a surface of the photosensitive element.

As is apparent from the above-described results, by using the (silver halide dissolving) processing element of the present invention, an image with excellent quality and stability in storage can be obtained by a simple and easy treatment without deposition on a surface of the photosensitive element, even when the silver complex compound remains in the photosensitive material.

What is claimed is:

1. A processing element comprising a treatment layer consisting essentially of binder and a silver halide solvent represented by a general formula (1):

General formula (1)

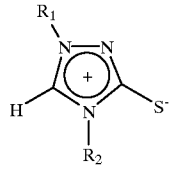

wherein $R_1$ and $R_2$ each represent an unsubstituted aliphatic hydrocarbon group.

2. A processing element according to claim 1, further comprising a neutralizer.

3. A processing element according to claim 2, wherein the neutralizer is an acid or an acid precursor.

4. A processing element according to claim 3, wherein the acid is an acid polymer.

5. An image-forming method for forming an image on a photosensitive element comprising steps:

imagewise exposing the photosensitive element having a photosensitive layer comprising a support having thereon a silver halide and a binder;

thereafter, conducting developing processing of the photosensitive element in the presence of at least a base;

subsequently, superposing a photosensitive layer of the photosensitive element, which has been subjected to developing processing, and a processing element on each other in the presence of water in an amount in a range of from 1 cc/m$^2$ to 50 cc/m$^2$ between the photosensitive layer and the processing element;

heating the superposed composite at a temperature in a range of from 40° C. to 100° C. for a period of time in a range of from 2 seconds to 60 seconds; and thereafter, separating the photosensitive element from the processing element, wherein the processing element is the processing element according to claim 1.

6. An image-forming method according to claim 5, wherein the photosensitive layer further comprises a coupler.

7. An image-forming method for forming an image on a photosensitive element comprising steps:

imagewise exposing the photosensitive element having a photosensitive layer comprising a support having thereon a silver halide, a color developing agent, a coupler and abinder;

thereafter, superimposing on each other a photosensitive layer of the photosensitive element, which has been subjected to the exposing treatment, and a processing layer of a developing processing element comprising a support having thereon a base and/or a base precursor, in the presence of water in an amount in a range of from 1 cc/m$^2$to 50 cc/m$^2$between the photosensitive layer and the treatment layer;

heating the superimposed composite at a temperature in a range of from 60° C. to 100° C. for a period of time in a range of from 5 seconds to 60 seconds;

thereafter, separating the photosensitive element from the developing processing element;

subsequently, superimposing the photosensitive layer of the photosensitive element, which has been subjected to developing processing, and a processing element on each other in the presence of water in an amount in a range of from 1 cc/m$^2$ to 50 cc/m$^2$between the photosensitive layer and the processing element;

heating the superimposed composite at a temperature in a range of from 40° C. to 100° C. for a period of time in a range of from 2 seconds to 60 seconds; and thereafter, separating the photosensitive element from the processing element, wherein the processing element is the processing element according to claim 1.

8. An image-forming method according to claim 6, wherein the photosensitive element contains at least one of color developing agents represented by the following general formulae (2) to (6):

General formula (2)

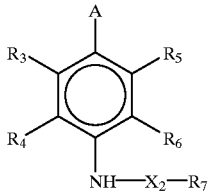

General formula (3)

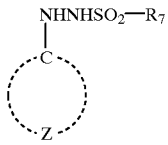

General formula (4)

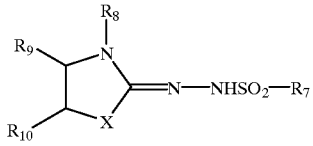

General formula (5)

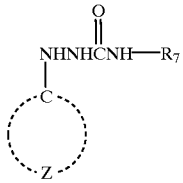

General formula (6)

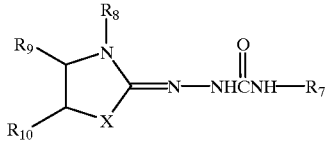

wherein A represents a hydroxyl group, or an amino group with a substituent; $X_2$ represents a connecting group selected from the group consisting of —CO—, —SO—, —$SO_2$— and —(Q)PO—(wherein Q represents a monovalent group that bonds to a phosphorus atom); each of $R_3$ to $R_6$ represents a hydrogen atom a halogen atom, an alkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, a ureido group, a urethane group, or an acyloxy group; and $R_7$ represents a substituted or unsubstituted alkyl group, aryl group or heterocyclic group;

wherein $R_3$ and $R_4$, and $R_5$ and $R_6$ may respectively be linked with each other to form a ring through coupling therebetween; and wherein Z represents an atomic group forming an aromatic ring or aromatic heterocyclic ring and when Z is a benzene ring having substituents, the sum of Hammett's constants (σ) of the substituents is 1 or more; $R_8$ represents an alkyl group with or without a substituent; X represents an oxygen atom, a sulfur atom, a selenium atom or a tertiary nitrogen atom with alkyl or aryl substituents; and $R_9$ and $R_{10}$ each represent a hydrogen atom or a substituent and may be linked with each other to form a double bond or a ring.

9. An image-forming method according to claim 7, wherein the photosensitive element includes at least one of color developing agents represented by the following general formulae (2) to (6).

General formula (2)

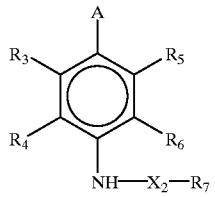

General formula (3)

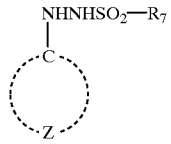

General formula (4)

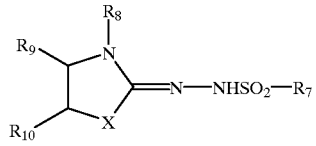

General formula (5)

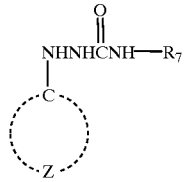

General formula (6)

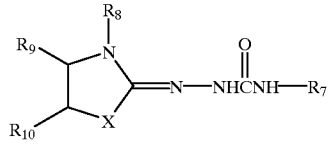

wherein A represents a hydroxyl group, or an amino group with a substituent; $X_2$ represents a connecting group selected from the group consisting of —CO—, —SO—, —$SO_2$— and —(Q)PO—(wherein Q represents a monovalent group that bonds to a phosphorus atom); each of $R_3$ to $R_6$ represents a hydrogen atom, a halogen atom, an alkyl group, an aryl group an alkylcarbonamide group, an arylcarbonamide group, an alkylsulfonamide group, an arylsulfonamide group, an alkoxy group an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group an arylcarbonyl group, a ureido group, a urethane group, or an acyloxy group; and $R_7$ represents a substituted or unsubstituted alkyl group, aryl group or heterocyclic group;

wherein $R_3$ and $R_4$, and $R_5$ and $R_6$ may respectively be linked with each other to form a ring through coupling therebetween; and wherein Z represents an atomic group forming an aromatic ring or aromatic heterocyclic ring and when Z is a benzene ring having substituents, the sum of Hammett's constants (σ) of the substituents is 1 or more; $R_8$ represents an alkyl group with or without a substituent; X represents an oxygen atom, a sulfur atom, a selenium atom or a tertiary nitrogen atom with alkyl or aryl substituents; and $R_9$ and $R_{10}$ each represent a hydrogen atom or a substituent and may be linked with each other to form a double bond or a ring.

10. An image-forming method according to claim 6, wherein the photosensitive element includes a compound represented by the following general formula (9):

General formula (9)

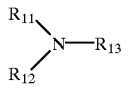

wherein $R_{11}$ and $R_{12}$ each independently represent a hydrogen atom, an aliphatic group or an aryl group; and $R_{13}$ represents an aliphatic group or a group represented by the following general formula (Ab):

General formula (Ab)

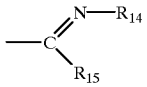

wherein $R_{14}$ represents a hydrogen atom, an aliphatic group or an aryl group; and $R_{15}$ represents an aliphatic group, an aryl group or an amino group; and wherein $R_{11}$ and $R_{12}$, $R_{11}$ and $R_{13}$, $R_{12}$ and $R_{13}$, and $R_{14}$ and $R_{15}$ may respectively be linked with each other to form a 5 to 7-elemented ring; three groups of $R_{11}$, $R_{12}$ and $R_{13}$ may be linked with each other to form a bicyclic compound, with the proviso that the total number of carbon atoms of $R_{11}$, $R_{12}$ and $R_{13}$ is 10 or more, and at least one of $R_{11}$ and $R_{12}$ is an aliphatic group and furthermore, when $R_{11}$ (or $R_{12}$) is an aliphatic group and $R_{12}$ (or $R_{11}$) is an aryl group, $R_{13}$ represents a group represented by the general formula (Ab).

11. An image-forming method according to claim 7, wherein the photosensitive element further includes a compound represented by the following general formula (9):

General formula (9)

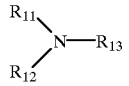

wherein $R_{11}$ and $R_{12}$ each independently represent a hydrogen atom; an aliphatic group or an aryl group; and $R_{13}$ represents an aliphatic group or a group represented by the following general formula (Ab)

General formula (Ab)

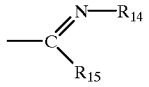

wherein $R_{14}$ represents a hydrogen atom, an aliphatic group or an aryl group; and $R_{15}$ represents an aliphatic group, an aryl group or an amino group; and wherein $R_{11}$ and $R_{12}$, $R_{11}$ and $R_{13}$, $R_{12}$ and $R_{13}$, and $R_{14}$ and $R_{15}$ may respectively be linked with each other to form a 5 to 7-elemented ring; three groups of $R_{11}$, $R_{12}$ and $R_{13}$ may be linked with each other to form a bicyclic compound, with the proviso that the total number of carbon atoms of $R_{11}$, $R_{12}$ and $R_{13}$ is 10 or more, and at least one of $R_{11}$ and $R_{12}$ is an aliphatic group and furthermore, when $R_{11}$ (or $R_{12}$) is an aliphatic group and $R_{12}$ (or $R_{11}$) is an aryl group, $R_{13}$ represents a group represented by the general formula (Ab).

12. An image-forming method according to claim 8, wherein the photosensitive element further includes a compound represented by the following general formula (9):

General formula (9)

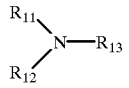

wherein $R_{11}$ and $R_{12}$ each independently represent a hydrogen atom, an aliphatic group or an aryl group; and $R_{13}$ represents an aliphatic group or a group represented by the following general formula (Ab)

General formula (Ab)

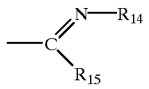

wherein $R_{14}$ represents a hydrogen atom, an aliphatic group or an aryl group; and $R_{15}$ represents an aliphatic group, an aryl group or an amino group; and wherein $R_{11}$ and $R_{12}$, $R_{11}$ and $R_{13}$, $R_{12}$ and $R_{13}$, and $R_{14}$ and $R_{15}$ may respectively be linked with each other to form a 5 to 7-elemented ring; three groups of $R_{11}$, $R_{12}$ and $R_{13}$ may be linked with each other to form a bicyclic compound, with the proviso that the total number of carbon atoms of $R_{11}$, $R_{12}$ and $R_{13}$ is 10 or more, and at least one of $R_{11}$ and $R_{12}$ is an aliphatic group and furthermore, when $R_{11}$ (or $R_{12}$) is an aliphatic group and $R_{12}$ (or $R_{11}$) is an aryl group, $R_{13}$ represents a group represented by the general formula (Ab).

13. An image-forming method according to claim 9, wherein the photosensitive element further includes a compound represented by the following general formula (9):

General formula (9)

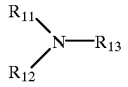

wherein $R_{11}$ and $R_{12}$ each independently represent a hydrogen atom, an aliphatic group or an aryl group; and $R_{13}$ represents an aliphatic group or a group represented by the following general formula (Ab)

General formula (Ab)

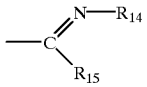

wherein $R_{14}$ represents a hydrogen atom, an aliphatic group or an aryl group; and $R_{15}$ represents an aliphatic group, an aryl group or an amino group; and wherein $R_{11}$ and $R_{12}$, $R_{11}$ and $R_{13}$, $R_{12}$ and $R_{13}$, and $R_{14}$ and $R_{15}$ may respectively be linked with each other to form a 5 to 7-elemented ring; three groups of $R_{11}$, $R_{12}$ and $R_{13}$ may be linked with each other to form a bicyclic compound, with the proviso that the total number of carbon atoms of $R_{11}$, $R_{12}$ and $R_{13}$ is 10 or more, and at least one of $R_{11}$ and $R_{12}$ is an aliphatic group and furthermore, when $R_{11}$ (or $R_{12}$) is an aliphatic group and $R_{12}$ (or $R_{11}$) is an aryl group, $R_{13}$ represents a group represented by the general formula (Ab).

14. An image-forming method comprising steps: forming a first image on a photosensitive element by means of the method according to claim 5; and then forming a second image on a different recording material based on information of the first image.

15. An image-forming method comprising steps: forming a first image on a photosensitive element by means of the method according to claim 7; and then forming a second image on a different recording material based on information of the first image.

16. An image-forming method comprising steps: forming a first image on a photosensitive element by means of the method according to claim 5; reading image information from the first image; and then forming a second image on a different recording material based on the image information.

17. An image-forming method comprising steps: forming a first image on a photosensitive element by means of the method according to claim 7; reading image information from the first image; and then forming a second image on a different recording material based on the image information.

18. A processing element according to claim 1, wherein $R_1$ is a straight-chain alkyl group without a substituent and having 1 to 3 carbon atoms, and $R_2$ is either a straight-chain, branched-chain, or cyclic alkyl group without a substituent and having 1 to 5 carbon atoms, or a straight-chain, branched-chain, or cyclic alkenyl group without a substituent and having 3 to 5 carbon atoms.

19. A processing element according to claim 1, wherein $R_1$ is a straight-chain alkyl group without a substituent and having 1 to 2 carbon atoms, and $R_2$ is either a straight-chain, branched-chain, or cyclic alkyl group without a substituent and having 1 to 3 carbon atoms, or an allyl group.

20. A processing element according to claim 1, wherein $R_1$ is a methyl group, and $R_2$ is a straight-chain alkyl group without a substituent and having 1 to 3 carbon atoms or an allyl group.

* * * * *